US010948866B2

(12) United States Patent
Ikeda et al.

(10) Patent No.: US 10,948,866 B2
(45) Date of Patent: Mar. 16, 2021

(54) ELECTROPHOTOGRAPHIC IMAGE FORMING APPARATUS AND ELECTROPHOTOGRAPHIC IMAGE FORMING METHOD

(71) Applicant: Konica Minolta, Inc., Tokyo (JP)

(72) Inventors: Kengo Ikeda, Kitamoto (JP); Hiroki Takao, Hachioji (JP); Tomoko Sakimura, Hino (JP); Mayuko Matsusaki, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 44 days.

(21) Appl. No.: 16/590,685

(22) Filed: Oct. 2, 2019

(65) Prior Publication Data

US 2020/0142344 A1 May 7, 2020

(30) Foreign Application Priority Data

Nov. 1, 2018 (JP) ..... JP2018-206674

(51) Int. Cl.
*G03G 5/05* (2006.01)
*G03G 15/00* (2006.01)
(Continued)

(52) U.S. Cl.
CPC ..... *G03G 15/75* (2013.01); *G03G 5/147* (2013.01); *G03G 5/14704* (2013.01); *G03G 9/09725* (2013.01); *G03G 21/0005* (2013.01)

(58) Field of Classification Search
CPC ... G03G 5/147; G03G 5/14704; G03G 9/0827
See application file for complete search history.

(56) References Cited

U.S. PATENT DOCUMENTS

2017/0168405 A1* 6/2017 Uchida ..... G03G 15/161
2018/0052403 A1* 2/2018 Inoue ..... G03G 9/08782

FOREIGN PATENT DOCUMENTS

JP 2012-32563 * 2/2012 ..... G03G 21/14
JP 2015084078 A 4/2015

OTHER PUBLICATIONS

Translation of JP 2012-32563.*

* cited by examiner

*Primary Examiner* — Peter L Vajda
(74) *Attorney, Agent, or Firm* — Lucas & Mercanti, LLP

(57) ABSTRACT

An electrophotographic image forming apparatus includes: an electrophotographic photoreceptor; a charger that charges a surface of the electrophotographic photoreceptor; an exposer that exposes the charged electrophotographic photoreceptor; a developer that supplies a toner to the electrophotographic photoreceptor on which an electrostatic latent image is formed; a transferer that transfers a toner image formed on the electrophotographic photoreceptor; and a cleaner that removes a residual toner remaining on a surface of the electrophotographic photoreceptor, wherein the electrophotographic photoreceptor includes an outermost layer, a surface of the outermost layer has a projection structure due to a ridge of the inorganic filler, the toner contains toner base particles and metal oxide particles as an external additive externally added to the toner base particles, 70% or more of the toner base particles are covered with the metal oxide particles as the external additive, and following formulas (1) to (3) are satisfied.

(Continued)

[Numerical formula 1]

$$R_2 \leq 2\sqrt{2R_1R_3 - R_1^2} \quad (1)$$

$$0 < R_1 < R_3 \quad (2)$$

$$0 < R_2 \leq 250 \quad (3)$$

9 Claims, 4 Drawing Sheets

(51) Int. Cl.
*G03G 21/00* (2006.01)
*G03G 9/097* (2006.01)
*G03G 5/147* (2006.01)

ELECTROPHOTOGRAPHIC IMAGE FORMING APPARATUS AND ELECTROPHOTOGRAPHIC IMAGE FORMING METHOD

The entire disclosure of Japanese patent Application No. 2018-206674, filed on Nov. 1, 2018, is incorporated herein by reference in its entirety.

BACKGROUND

Technological Field

The present invention relates to an electrophotographic image forming apparatus and an electrophotographic image forming method.

Description of the Related Art

An electrophotographic type image forming apparatus (electrophotographic image forming apparatus, hereinafter also simply referred to as "image forming apparatus") includes an electrophotographic photoreceptor (hereinafter also simply referred to as "photoreceptor") as a means for forming an electrostatic latent image according to a light signal corresponding to an image to be formed. An organic photoreceptor containing an organic photoconductive material is widely used as the photoreceptor, and electric energy, light energy, a mechanical force, and the like are supplied in various steps such as charging, exposure, development, transfer, and cleaning in image formation. Therefore, it is required for the photoreceptor not to impair charge stability, potential retention, and the like even after image formation is repeated. In response to such a demand, there is known a technique for disposing a protective layer containing inorganic particles on a surface of a photoreceptor.

In the electrophotographic type image forming apparatus, it is required to cope with an increase in a printing speed (the number of printed sheets per hour). In order to increase the printing speed, it is necessary to increase a line speed of the image forming apparatus. Therefore, it is necessary to increase a rotational speed of the photoreceptor, and simultaneously to increase a rotational speed of a developing sleeve of a developing device to ensure developability.

Furthermore, in recent years, a spherical toner having a small particle diameter has become mainstream due to an increase in demand for high definition and high quality images. The spherical toner having a small particle diameter has a large adhesion to a surface of a photoreceptor, and removal of a residual toner such as a transfer residual toner adhering to the surface tends to be insufficient. In a cleaner using a cleaning blade, toner slippage tends to occur, and in order to solve the toner slippage, it is necessary to increase a contact pressure of the blade to a photoreceptor. However, when the contact pressure of the blade to the photoreceptor is increased, abrasion of the photoreceptor and the cleaning blade is likely to progress at the time of cleaning, and the lives of the photoreceptor and the cleaning blade are shortened. Therefore, in order to reduce abrasion of the photoreceptor and the cleaning blade, a lubricant supplying step is provided in image formation, and a lubricant is supplied to a surface of the photoreceptor at the time of cleaning. Supply of a lubricant reduces excessive deformation of the cleaning blade at the time of contact between the cleaning blade and the photoreceptor, and further reduces toner slippage. As described above, supply of a lubricant contributes to prolonging the lives of the photoreceptor and the cleaning blade and also contributes to achieving high definition and high quality images.

Meanwhile, regarding supply of a lubricant, it is known that image defects may occur, for example, due to the uneven thickness of a lubricant film covering a surface of the photoreceptor. Conditions under which a lubricant is not supplied or the amount of a lubricant supplied is small may be selected. In addition, the amount of a lubricant supplied to the photoreceptor may be reduced due to repeated use. Therefore, it is desirable to achieve long lives of the photoreceptor and the cleaning blade and to achieve high definition and high quality images even in a state where a surface of the photoreceptor is not completely covered with a lubricant.

In view of such a current situation, attention has been attracted to a technique related to improvement of cleaning performance and prolongation of the lives of the photoreceptor and the cleaning blade from a viewpoint other than a viewpoint regarding a lubricant such as the type of lubricant, a method for supplying a lubricant, or conditions. Here, JP 2015-84078 A discloses an image forming apparatus including: a toner containing two types of external additives that become free in a large amount; an electrophotographic photoreceptor including a protective layer containing a curable resin; and a cleaning blade, in which the particle diameters of the two types of external additives and the height of a projection of the photoreceptor satisfy a predetermined relationship. JP 2015-84078 A discloses that this image forming apparatus can achieve excellent cleaning performance and can form a good image for a long time.

However, the image forming apparatus described in JP 2015-84078 A does not have a sufficient toner slippage suppressing effect under conditions under which a lubricant is not supplied or the amount of a lubricant supplied is small, and abrasion of the photoreceptor and the cleaning blade cannot be suppressed sufficiently disadvantageously. Furthermore, under the above conditions, an excessive amount of free external additive that has passed through a cleaning device, aggregates thereof, aggregates of the toner and the free external additive, and the like float in the image forming apparatus to contaminate the inside of the apparatus. In a case of using a lubricant application brush as a lubricant supplier, the free external additives and the aggregates contaminate the brush to cause image defects disadvantageously. These disadvantages are more significant when a printing speed is increased.

SUMMARY

Therefore, an object of the present invention is to provide an electrophotographic image forming apparatus and an electrophotographic image forming method, capable of improving cleaning performance and reducing abrasion of the photoreceptor and the cleaning blade regardless of presence or absence of a lubricant and the amount thereof supplied.

To achieve the abovementioned object, according to an aspect of the present invention, an electrophotographic image forming apparatus reflecting one aspect of the present invention comprises: an electrophotographic photoreceptor; a charger that charges a surface of the electrophotographic photoreceptor; an exposer that exposes the charged electrophotographic photoreceptor to form an electrostatic latent image; a developer that supplies a toner to the electrophotographic photoreceptor on which the electrostatic latent image is formed to form a toner image; a transferer that transfers a toner image formed on the electrophotographic photoreceptor; and a cleaner that removes a residual toner remaining on a surface of the electrophotographic photoreceptor, wherein the electrophotographic photoreceptor includes an outermost layer formed of a polymerized and cured product of a composition containing a polymerizable monomer and an inorganic filler, a surface of the outermost layer has a projection structure due to a ridge of the inorganic filler, the toner contains toner base particles and metal oxide particles as an external additive externally added to the toner base particles, 70% or more of the toner base particles are covered with the metal oxide particles as the external additive, and following formulas (1) to (3) are satisfied if an average projection height (nm) of the outermost layer is represented by $R_1$, an average distance (nm) between projections of a projection structure due to a ridge of the inorganic filler in the outermost layer is represented by $R_2$, and an approximate true sphere radius (nm) of the toner is represented by $R_3$.

[Numerical formula 1]

$$R_2 \leq 2\sqrt{2R_1R_3 - R_1^2} \quad (1)$$

$$0 < R_1 < R_3 \quad (2)$$

$$0 < R_2 \leq 250 \quad (3)$$

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
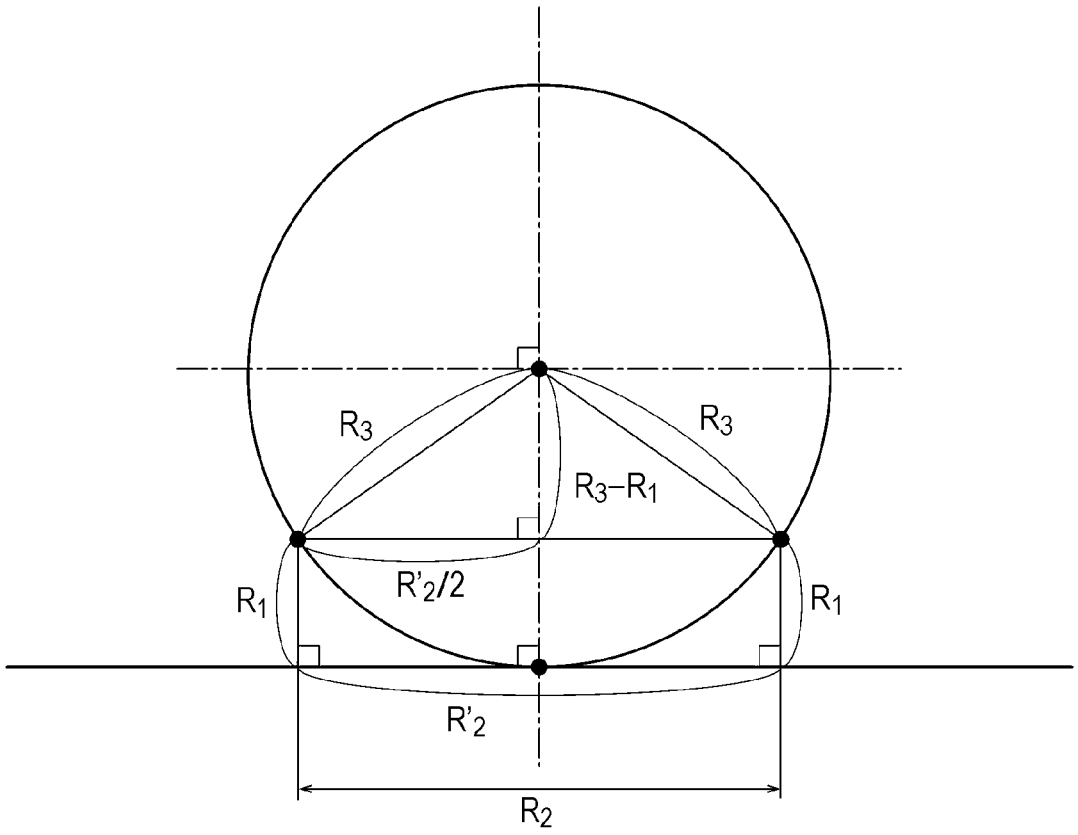
FIG. 1 is an explanatory diagram for explaining a relationship to be satisfied in a contact state between a toner and a photoreceptor in an electrophotographic image forming apparatus according to an embodiment of the present invention and an electrophotographic image forming method according to an embodiment of the present invention.

Hereinafter, one or more embodiments of the present invention will be described with reference to the drawings. However, the scope of the invention is not limited to the disclosed embodiments. Here, "X to Y" indicating a range means "X or more and Y or less". Unless otherwise specified, operation, measurement of physical properties, and the like are performed under conditions of room temperature (20 to 25° C.)/relative humidity 40 to 50% RH.

"(Meth)acrylate" is a generic term for acrylate and methacrylate. A compound or the like including (meth), such as (meth)acrylic acid, is similarly a generic term for a compound including "meth" and a compound not including "meth" in a name.

In the description of the drawings, the same elements are denoted by the same reference numerals, and duplicate description is omitted. A dimensional ratio in the drawings is exaggerated for convenience of explanation and may differ from the actual ratio.

<Electrophotographic Image Forming Apparatus and Electrophotographic Image Forming Method>

An embodiment of the present invention relates to an electrophotographic image forming apparatus including an electrophotographic photoreceptor, a charger, an exposer, a developer, a transferer, and a cleaner, in which the electrophotographic photoreceptor includes an outermost layer formed of a polymerized and cured product of a composition containing a polymerizable monomer and an inorganic filler, a surface of the outermost layer has a projection structure due to a ridge of the inorganic filler, the toner includes toner base particles and metal oxide particles as an external additive externally added to the toner base particles (here, also referred to as "external additive metal oxide particles"), 70% or more of the toner base particles are covered with the external additive metal oxide particles, and an average projection height $R_1$ (nm) of the outermost layer, an average distance $R_2$ (nm) between projections of a projection structure due to a ridge of the inorganic filler in the outermost layer, and an approximate true sphere radius $R_3$ (nm) of the toner satisfy a predetermined relationship.

Another embodiment of the present invention relates to an electrophotographic image forming method including a charging step, an exposing step, a developing step, a transferring step, and a cleaning step, in which the electrophotographic photoreceptor includes an outermost layer formed of a polymerized and cured product of a composition containing a polymerizable monomer and an inorganic filler, a surface of the outermost layer has a projection structure due to a ridge of the inorganic filler, the toner includes toner base particles and external additive metal oxide particles externally added to the toner base particles, 70% or more of the toner base particles are covered with the external additive metal oxide particles, and an average projection height $R_1$ (nm) of the outermost layer, an average distance $R_2$ (nm) between projections of a projection structure due to a ridge of the inorganic filler in the outermost layer, and an approximate true sphere radius $R_3$ (nm) of the toner satisfy a predetermined relationship.

FIG. 1 is an explanatory diagram for explaining a contact state between a toner and a photoreceptor in an electrophotographic image forming apparatus according to an embodiment of the present invention and an electrophotographic image forming method according to an embodiment of the present invention. In FIG. 1, $R_1$ represents an average projection height (nm) of an outermost layer, $R_2$ represents an average distance (nm) between projections of a projection structure due to a ridge of the inorganic filler in the outermost layer, and $R_3$ represents an approximate true sphere radius (nm) of the toner. $R_1$ to $R_3$ satisfy relationships of the following formulas (1) to (3). $R_2'$ represents a maximum value (nm) of an average distance (nm) between projections of a projection structure due to a ridge of the inorganic filler in the outermost layer, calculated from a relationship with $R_1$ and $R_3$, and satisfies the following formula (4).

[Numerical formula 3]

$$R_2 \leq 2\sqrt{2R_1R_3 - R_1^2} \quad (1)$$

$$0 < R_1 < R_3 \quad (2)$$

$$0 < R_2 \leq 250 \quad (3)$$

[Numerical formula 4]

$$R_2' = 2\sqrt{2R_1R_3 - R_1^2} \quad (4)$$

The present inventors estimate a mechanism by which the problem is solved with the above-described configuration as follows.

In the present invention, the average distance $R_2$ between projections of a projection structure due to a ridge of the inorganic filler in the outermost layer satisfies the formula (1). That is, $R_2$ is equal to or less than $R_2'$ which is a maximum value (nm) of an average distance between projections of a projection structure due to a ridge of the inorganic filler in the outermost layer, represented by the formula (4) and calculated from a relationship with $R_1$ and $R_3$. At this time, the toner comes into contact mainly with the projection structure in the outermost layer. The toner contains metal oxide particles as an external additive, 70% or more of the toner base particles are covered with the external additive metal oxide particles, and a surface of the outermost layer has a projection structure due to a ridge of the inorganic filler. Therefore, the toner particles contained in the toner come into contact with the outermost layer mainly by a contact between the external additive metal oxide particles and the inorganic filler.

Meanwhile, when the average distance $R_2$ between projections of a projection structure due to a ridge of the inorganic filler in the outermost layer exceeds $R_2'$ represented by the formula (4), the toner particles come into contact mainly with a portion other than the projection structure in the outermost layer. At this time, the toner particles come into contact with the outermost layer mainly by contact between the external additive metal oxide particles and a resin portion of the polymerized and cured product constituting the outermost layer.

As the toner particles, toner particles having a coverage of less than 70% by the external additive metal oxide particles of the toner base particles, and toner particles including only the toner base particles without any external additive may exist. In these cases, the toner particles come into contact with the outermost layer mainly between the toner base particles and the outermost layer. As the outermost layer, an outermost layer containing no inorganic filler may exist. In this case, the toner particles come into contact with the outermost layer mainly between the toner particles and a resin portion of a polymerized and cured product.

Regarding a form of a contact between the toner and the outermost layer including these forms, if adhesion and friction between the toner base particles and the resin portion of the polymerized and cured product constituting the outermost layer, adhesion and friction between the toner base particles and the inorganic filler, adhesion and friction between the external additive and the resin portion of the polymerized and cured product, and adhesion and friction between the external additive and the inorganic filler are compared with one another, the adhesion and friction between the external additive and the inorganic filler is the smallest.

Therefore, in the present invention, even under conditions under which a lubricant is not supplied or the amount of a lubricant supplied is small, it is possible to reduce a rushing force when a residual toner rushes into a cleaning blade. Furthermore, a residual toner can be removed from the outermost layer reliably and promptly at the time of cleaning. In addition, slippage of a residual toner at the time of cleaning and release of the external additive due to the above-described rushing force and convection of the residual toner are suppressed, and slippage of an excessive amount of free external additive, aggregates thereof, and aggregates of the toner and the free external additive is also reduced. As a result, a load at the time of cleaning is reduced, abrasion of the photoreceptor and the cleaning blade is reduced, cleaning performance is improved, contamination in the apparatus by the free external additive is suppressed, and occurrence of image defects is reduced.

In the present invention, $R_2$ is essentially 250 nm or less. A reason for this is presumed as follows. When $R_2$ is more than 250 nm, even if $R_2$ is equal to or less than $R_2'$, the contact between the cleaning blade and the resin portion of the polymerized and cured product constituting the outermost layer is excessive, thereby increasing the abrasion amount of the photoreceptor. The increase in abrasion amount further facilitates slippage of an excessive amount of free external additive, aggregates thereof, aggregates of the toner and the free external additive, and the like. In addition, the toner is more likely to come into contact with the resin portion of the polymerized and cured product, thereby increasing adhesion and friction between the toner and the outermost layer and increasing the rushing force when the residual toner rushes into the cleaning blade. The increase in rushing force further promotes release of the external additive, and further facilitates slippage of an excessive amount of free external additive, aggregates thereof, aggregates of the toner and the free external additive, and the like. As a result, sufficient cleaning performance cannot be obtained, the load at the time of cleaning increases, and the abrasion amount of the cleaning blade also increases.

Note that when a printing speed is increased, an increase in linear velocity increases a rushing force when a residual toner rushes into the cleaning blade, and the contact pressure of the blade to the photoreceptor is unlikely to be stabilized. Therefore, abrasion of the photoreceptor and the cleaning blade and occurrence of image defects become more significant. Therefore, the present invention exhibits an effect thereof regardless of the printing speed, but exhibits a particularly high effect when the printing speed is high.

Note that the above mechanism is based on speculation, and correctness or fault of the mechanism does not affect the technical scope of the present invention.

<Electrophotographic Image Forming Apparatus>

An electrophotographic image forming apparatus according to an embodiment of the present invention includes: an electrophotographic photoreceptor; a charger that charges a surface of the electrophotographic photoreceptor; an exposer that exposes the charged electrophotographic photoreceptor to form an electrostatic latent image; a developer that supplies a toner to the electrophotographic photoreceptor on which the electrostatic latent image is formed to form a toner image; a transferer that transfers a toner image formed on the electrophotographic photoreceptor; and a cleaner that removes a residual toner remaining on a surface of the electrophotographic photoreceptor. The image forming apparatus according to an embodiment of the present invention preferably further includes a lubricant supplier that supplies a lubricant to a surface of the electrophotographic photoreceptor in addition to these means.

Hereinafter, an image forming apparatus according to an embodiment of the present invention will be described with reference to the attached drawings. However, the present invention is not limited only to an embodiment described below.

Figure 2:
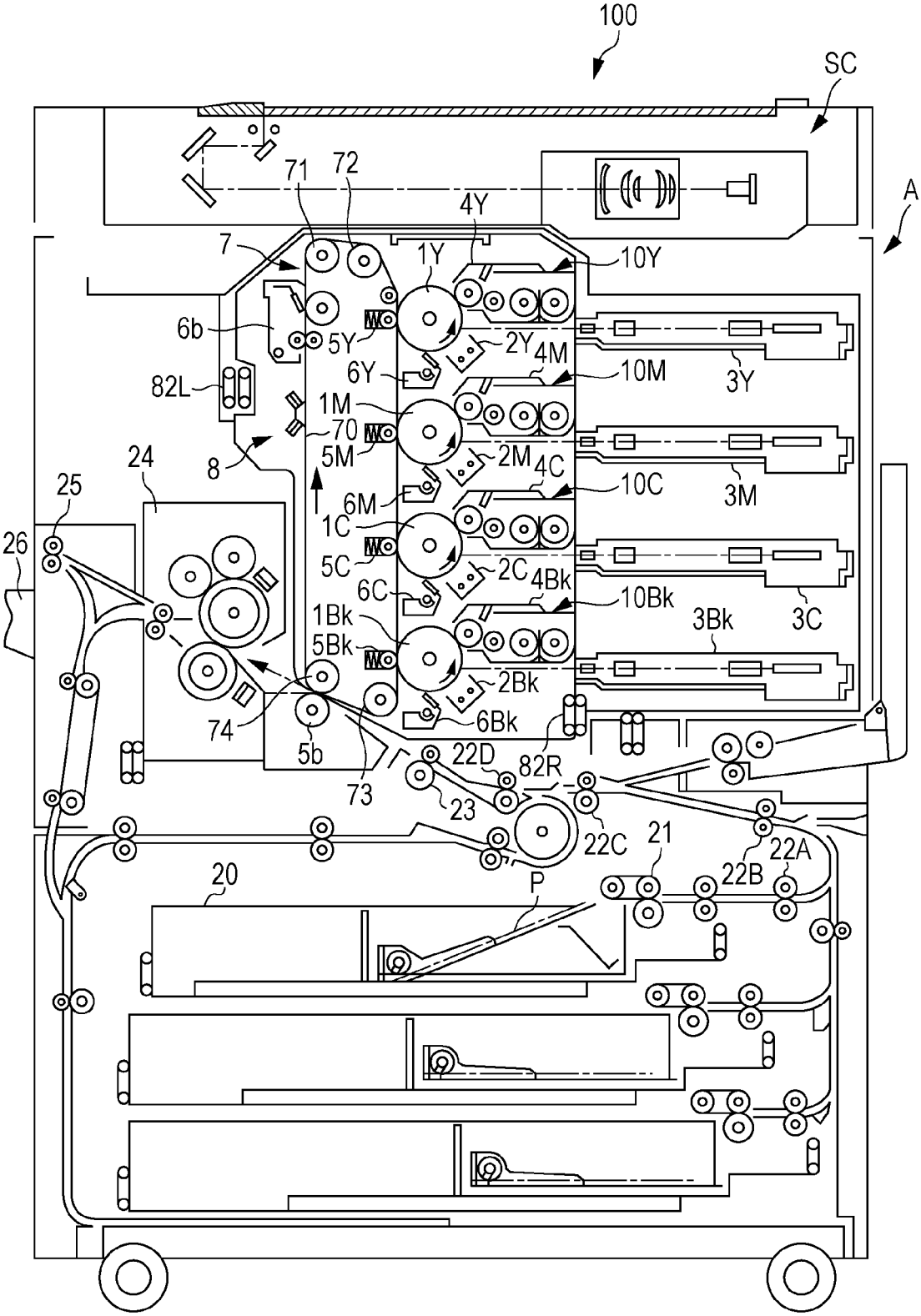
FIG. 2 is a schematic configuration view exemplifying a configuration of the electrophotographic image forming apparatus according to an embodiment of the present invention.
Figure 3:
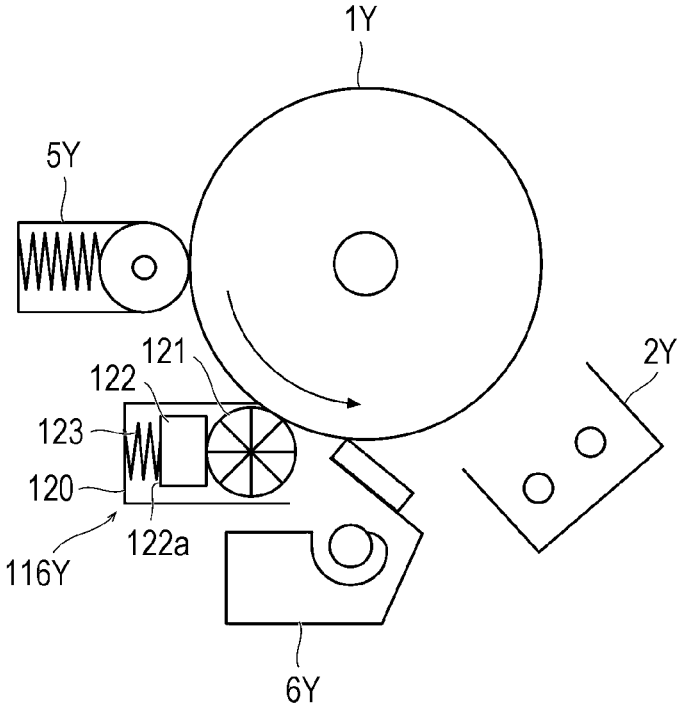
FIG. 3 is a schematic configuration view exemplifying a non-contact type charger and a lubricant supplier included in the electrophotographic image forming apparatus according to an embodiment of the present invention.
Figure 4:
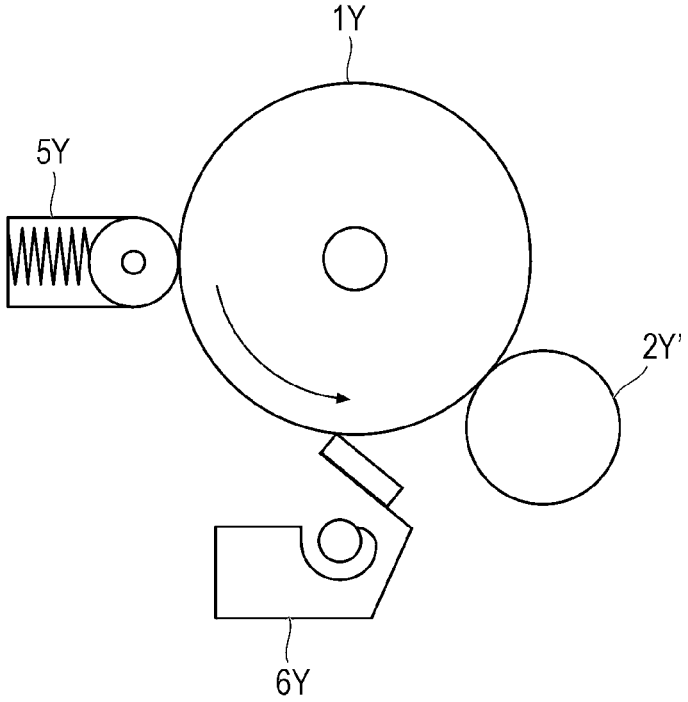
FIG. 4 is a schematic configuration view exemplifying a proximity charging type charger included in an image forming apparatus according to another embodiment of the present invention.

FIG. 2 is a schematic configuration view exemplifying a configuration of the electrophotographic image forming apparatus according to an embodiment of the present invention. FIG. 3 is a schematic configuration view exemplifying a non-contact type charger and a lubricant supplier included in the electrophotographic image forming apparatus according to an embodiment of the present invention. FIG. 4 is a schematic configuration view exemplifying a proximity charging type charger included in an image forming apparatus according to another embodiment of the present invention.

An image forming apparatus 100 illustrated in FIG. 1 is referred to as a tandem type color image forming apparatus, and includes four sets of image forming units 10Y, 10M, 10C, and 10Bk, an endless belt-shaped intermediate transfer body unit 7, a sheet feeder 21, and a fixer 24. An original image reading device SC is disposed above an apparatus main body A of the image forming apparatus 100.

The image forming unit 10Y that forms a yellow image includes a charger 2Y, an exposer 3Y, a developer 4Y, a primary transfer roller (primary transferer) 5Y, and a cleaner 6Y, sequentially disposed around a drum-shaped photoreceptor 1Y in a rotation direction of the photoreceptor 1Y.

The image forming unit 10M that forms a magenta image includes a charger 2M, an exposer 3M, a developer 4M, a primary transfer roller (primary transferer) 5M, and a cleaner 6M, sequentially disposed around a drum-shaped photoreceptor 1M in a rotation direction of the photoreceptor 1M.

The image forming unit 10C that forms a cyan image includes a charger 2C, an exposer 3C, a developer 4C, a primary transfer roller (primary transferer) 5C, and a cleaner 6C, sequentially disposed around a drum-shaped photoreceptor 1C in a rotation direction of the photoreceptor 1C.

The image forming unit 10Bk that forms a black image includes a charger 2Bk, an exposer 3Bk, a developer 4Bk, a primary transfer roller (primary transferer) 5Bk, and a cleaner 6Bk, sequentially disposed around a drum-shaped photoreceptor 1Bk in a rotation direction of the photoreceptor 1Bk.

As each of the photoreceptors 1Y, 1M, 1C, and 1Bk, an electrophotographic photoreceptor described later is used.

The image forming units 10Y, 10M, 10C, and 10Bk are configured similarly to one another except that the colors of toner images formed on the photoreceptors 1Y, 1M, 1C, and 1Bk are different from one another. Therefore, the image forming unit 10Y will be described in detail as an example, and description of the image forming units 10M, 10C, and 10Bk will be omitted.

The image forming unit 10Y includes the charger 2Y, the exposer 3Y, the developer 4Y, the primary transfer roller (primary transferer) 5Y, and the cleaner 6Y around the photoreceptor 1Y as an image forming body, and forms a yellow (Y) toner image on the photoreceptor 1Y. In the present embodiment, at least the photoreceptor 1Y, the charger 2Y, the developer 4Y, and the cleaner 6Y in the image forming unit 10Y are integrally disposed.

The charger 2Y applies a uniform potential to the photoreceptor 1Y. As the charger 2Y, for example, a non-contact type charging device such as a corona discharge type charging device including a scorotron charging device as illustrated in FIGS. 2 and 3 can be used.

As the charger 2Y, in place of the non-contact type charging device, a charger 2Y' that is a proximity charging type charging device that performs charging in such a manner that a charging roller is in contact with or in proximity to a photoreceptor as illustrated in FIG. 4 can be used. The charger 2Y' charges a surface of the photoreceptor 1Y with a charging roller. The charger 2Y' of this example includes a charging roller disposed in contact with a surface of the photoreceptor 1Y and a power source that applies a voltage to the charging roller. The charging roller includes, for example, a core metal and an elastic layer laminated on a surface of the core metal to reduce charging noise and to impart elasticity to obtain uniform adhesion to the photoreceptor 1Y. On a surface of the elastic layer, if necessary, a resistance control layer is laminated such that the charging roller as a whole obtains highly uniform electrical resistance. On the resistance control layer, a surface layer is laminated. The charging roller is urged in a direction of the photoreceptor 1Y by a pressing spring and is pressure-welded against a surface of the photoreceptor 1Y with a predetermined pressing force to form a charging nip portion, and is rotated according to rotation of the photoreceptor 1Y.

When the charger 2Y' is used as the charger 2Y, in the above-described technique of JP 2015-84078 A, an external additive is easily released from a toner at the time of cleaning, a charging roller is contaminated by slippage of the free external additive, aggregates thereof, and aggregates of the toner and the free external additive at the time of cleaning, and furthermore, image defects may occur due to the contamination of the charging roller. However, in the electrophotographic image forming apparatus according to an embodiment of the present invention, as described above, release of the external additive due to a rushing force when a residual toner rushes into a cleaning blade and convection of the residual toner is suppressed, and slippage of an excessive amount of free external additive, aggregates thereof, and aggregates of the toner and the free external additive is also reduced. As a result, contamination of the charging roller due to the free external additive is suppressed, and occurrence of image defects is reduced.

The exposer 3Y performs exposure on the photoreceptor 1Y to which a uniform potential has been applied by the charger 2Y based on an image signal (yellow) to form an electrostatic latent image corresponding to a yellow image. Examples of the exposer 3Y include an exposer including an LED in which light emitting elements are arrayed in an axial direction of the photoreceptor 1Y and an imaging element, and a laser optical system exposer.

The developer 4Y includes, for example, a developing sleeve having a built-in magnet, holding a developing agent, and rotating, and a voltage applying device that applies a DC and/or AC bias voltage between the photoreceptor 1Y and the developing sleeve.

The primary transfer roller 5Y transfers a toner image formed on the photoreceptor 1Y onto an endless belt-shaped intermediate transfer body 70 (primary transferer). The primary transfer roller 5Y is disposed in contact with the intermediate transfer body 70.

A lubricant supplier 116Y that supplies (applies) a lubricant to a surface of the photoreceptor 1Y is disposed on a downstream side of the primary transfer roller (primary transferer) 5Y and on an upstream side of the cleaner 6Y, for example, as illustrated in FIG. 3. However, the lubricant supplier 116Y may be disposed on a downstream side of the cleaner 6Y.

Examples of a brush roller 121 constituting the lubricant supplier 116Y include a brush roller obtained by forming a pile woven fabric in which a bundle of fibers is woven into a base fabric as a pile yarn into a ribbon-shaped fabric, and spirally winding the ribbon-shaped fabric around a metal shaft with a brushed surface outside for bonding. The brush roller 121 of this example is obtained by forming a long woven fabric in which resin brush fibers such as polypropylene brush fibers are densely planted on a peripheral surface of a roller base.

A brush hair is preferably a straight hair type which is raised in a direction perpendicular to the metal shaft from a viewpoint of lubricant applicating ability. A yarn used for the brush hair is desirably a filament yarn, and examples of a material thereof include a synthetic resin such as a polyimide including 6-nylon and 12-nylon, a polyester, an acrylic resin, or vinylon. A yarn kneaded with carbon or a metal such as nickel may also be used for the purpose of enhancing conductivity. The brush fiber preferably has a thickness of, for example, 3 to 7 deniers, a hair length of, for example, 2 to 5 mm, an electrical resistivity of, for example, $1\times10^{10}\Omega$ or less, a Young's modulus of 4900 to 9800 $N/mm^2$, and a planting density (the number of brush fibers per unit area) of, for example, 50,000 to 200,000 fibers/square inch (50 k to 200 k fibers/$inch^2$). The biting amount of the brush roller 121 with respect to the photoreceptor is preferably 0.5 to 1.5 mm. The rotational speed of the brush roller is, for example, 0.3 to 1.5 in terms of a peripheral speed ratio with respect to the photoreceptor. The brush roller may rotate in the same direction as the rotational direction of the photoreceptor or in the opposite direction thereto.

As a pressure spring 123, a pressure spring that presses a lubricant 122 in a direction approaching the photoreceptor 1Y such that a pressing force of the brush roller 121 against the photoreceptor 1Y is, for example, 0.5 to 1.0 N is used.

In the lubricant supplier 116Y, for example, the pressing force of the lubricant 122 against the brush roller 121 and the rotational speed of the brush roller 121 are adjusted such that the lubricant consumption amount per km of accumulated length on a surface of the rotating photoreceptor is preferably 0.05 to 0.27 g/km, and more preferably 0.05 to 0.15 g/km which is a smaller amount.

The type of the lubricant 122 is not particularly limited, and a known lubricant can be appropriately selected. However, the lubricant 122 preferably contains a fatty acid metal salt.

The fatty acid metal salt is preferably a metal salt of a saturated or unsaturated fatty acid having 10 or more carbon atoms. Examples thereof include zinc laurate, barium stearate, lead stearate, iron stearate, nickel stearate, cobalt stearate, copper stearate, strontium stearate, calcium stearate, cadmium stearate, magnesium stearate, zinc stearate, aluminum stearate, indium stearate, potassium stearate, lithium stearate, sodium stearate, zinc oleate, magnesium oleate, iron oleate, cobalt oleate, copper oleate, lead oleate, manganese oleate, aluminum oleate, zinc palmitate, cobalt palmitate, lead palmitate, magnesium palmitate, aluminum palmitate, calcium palmitate, lead caprate, zinc linolenate, cobalt linolenate, calcium linolenate, zinc ricinoleate, and cadmium ricinoleate. Among these compounds, zinc stearate is particularly preferable from viewpoints of an effect as a lubricant, availability, cost, and the like.

As the lubricant supplier, in place of a lubricant supplier that supplies a lubricant by a method for applying the solid lubricant 122 with the brush roller 116Y as described above, a lubricant may be supplied to a surface of the electrophotographic photoreceptor by action of a developing electric field formed in the developer by externally adding a fine powder lubricant to toner base particles in preparation of a toner.

The cleaner 6Y includes a cleaning blade and a brush roller disposed on an upstream side of the cleaning blade.

The endless belt-shaped intermediate transfer body unit 7 includes an endless belt-shaped intermediate transfer body 70 wound around a plurality of rollers 71 to 74 and rotatably supported by the plurality of rollers 71 to 74. The endless belt-shaped intermediate transfer body unit 7 includes a cleaner 6*b* that removes a toner on the intermediate transfer body 70.

The image forming units 10Y, 10M, 10C, and 10Bk, and the endless belt-shaped intermediate transfer body unit 7 constitute a housing 8. The housing 8 can be pulled out of the apparatus main body A via support rails 82L and 82R.

Examples of the fixer 24 include a heating roller fixing type fixer including a heating roller with a heating source therein and a pressure roller disposed while being pressure-welded such that a fixing nip portion is formed on the heating roller.

Note that in the above embodiment, the image forming apparatus 100 is a color laser printer, but the image forming apparatus 100 may be a monochrome laser printer, copier, multifunction machine, or the like. An exposure light source may be a light source other than a laser, such as an LED light source.

The electrophotographic image forming apparatus according to an embodiment of the present invention may further include a lubricant remover that removes a lubricant from a surface of the photoreceptor, if necessary. Specifically, for example, in the image forming apparatus 100, the lubricant supplier 116Y is disposed in a downstream side of the cleaner 6Y and on an upstream side of the charger 2Y in a rotational direction of the photoreceptor 1Y, and the lubricant remover is further disposed on a downstream side of the lubricant supplier 116Y and on an upstream side of the charger 2Y to constitute the image forming apparatus.

The lubricant remover preferably removes a lubricant by mechanical action caused when a removing member is in contact with a surface of the photoreceptor 1Y, and can be a removing member such as a brush roller or a foam roller.

The present invention is more effective in a case where a printing speed is high. Therefore, the electrophotographic image forming apparatus can preferably achieve a printing speed of 70 sheets/minute (A4 width) or more.

<Electrophotographic Image Forming Method>

An electrophotographic image forming method according to an embodiment of the present invention includes: a charging step that charges a surface of an electrophotographic photoreceptor; an exposing step that exposes the charged electrophotographic photoreceptor to form an electrostatic latent image; a developing step that supplies a toner to the exposed electrophotographic photoreceptor to form a toner image; a transferring step that transfers a toner image formed on the electrophotographic photoreceptor; and a cleaning step that removes a residual toner remaining on a surface of the electrophotographic photoreceptor. The image forming method according to an embodiment of the present invention preferably further includes a lubricant supplying step that supplies a lubricant to a surface of the electrophotographic photoreceptor in addition to these steps.

In the image forming apparatus 100 configured as described above, an image is formed on a sheet P as follows.

First, surfaces of the photoreceptors 1Y, 1M, 1C, and 1Bk are negatively charged by the chargers 2Y, 2M, 2C, and 2Bk (charging step). Note that the charger 2Y is not particularly limited as long as applying a uniform potential to the photoreceptor 1Y as described above. As the charger 2Y, for example, a non-contact type charging device such as a corona discharge type charging device including a scorotron charging device as illustrated in FIGS. 2 and 3 can be used. As the charger 2Y, the charger 2Y' that is a proximity charging type charging device that performs charging in such a manner that a charging roller is in contact with or in proximity to a photoreceptor as illustrated in FIG. 4 can be used.

Subsequently, the surfaces of the photoreceptors 1Y, 1M, 1C, and 1Bk are exposed by the exposers 3Y, 3M, 3C, and 3Bk based on image signals to form electrostatic latent images (exposing step).

Subsequently, a toner is applied to the surfaces of the photoreceptors 1Y, 1M, 1C, and 1Bk by the developers 4Y, 4M, 4C, and 4Bk, and developed to form a toner image (developing step).

Subsequently, the primary transfer rollers 5Y, 5M, 5C, and 5Bk sequentially transfer the toner images of the respective colors formed on the photoreceptors 1Y, 1M, 1C, and 1Bk onto the rotating intermediate transfer body 70 (primary transfer, transferring step) to form a color image on the intermediate transfer body 70.

Then, although not essential, if necessary, the primary transfer rollers 5Y, 5M, 5C, and 5Bk and the intermediate transfer body 70 are separated from each other, and then a lubricant is supplied to the surfaces of the photoreceptors 1Y, 1M, 1C, and 1Bk by a lubricant supplier (lubricant supplying step).

Thereafter, the toner remaining on the surfaces of the photoreceptors 1Y, 1M, 1C, and 1Bk is removed by the cleaners 6Y, 6M, 6C, and 6Bk.

Then, in preparation for a next image forming process, the photoreceptors 1Y, 1M, 1C, and 1Bk are negatively charged by the chargers 2Y, 2M, 2C, and 2Bk.

Meanwhile, the sheet P is fed from a sheet feeding cassette 20 by the sheet feeder 21 and conveyed to a secondary transfer unit (secondary transferer) 5*b* through a plurality of intermediate rollers 22A, 22B, 22C, and 22D and a resist roller 23. Then, a color image is transferred (secondarily transferred) onto the sheet P by the secondary transfer unit 5*b*.

The sheet P onto which the color image has been transferred is fixed by the fixer 24. Thereafter, the sheet P is nipped by a sheet discharge roller 25, discharged out of the apparatus, and placed on a sheet discharge tray 26. After the sheet P is separated from the intermediate transfer body 70, the cleaner 6*b* removes a residual toner on the intermediate transfer body 70.

The electrophotographic image forming apparatus according to an embodiment of the present invention may further include a lubricant removing step, if necessary. For example, a removing member is in contact with a surface of the photoreceptor 1Y on a downstream side of the lubricant supplying step and on an upstream side of the charging step in a rotational direction of the photoreceptors 1Y, 1M, 1C, and 1Bk, and removes a lubricant by mechanical action (lubricant removing step).

The present invention is more effective in a case where a printing speed is high. Therefore, the electrophotographic image forming method preferably achieves a printing speed of 70 sheets/minute (A4 width) or more.

An image can be formed on the sheet P as described above.

<Electrophotographic Photoreceptor>

In the electrophotographic image forming apparatus and the electrophotographic image forming method according to an embodiment of the present invention, an electrophotographic photoreceptor is used.

The electrophotographic photoreceptor is an object that carries a latent image or a developed image on a surface thereof in an electrophotographic type image forming method. The photoreceptor has a similar configuration to a conventional photoreceptor except that the photoreceptor has an outermost layer described later, and can be prepared in a similar manner to a conventional photoreceptor. The outermost layer also has a similar configuration to a conventional outermost layer within a range including characteristics described later, and can be prepared in a similar manner to the conventional outermost layer. A portion other than the outermost layer can have the same configuration as a portion other than an outermost layer in a photoreceptor described in, for example, JP 2012-078620 A. The outermost layer can also have the same configuration as that described in JP 2012-078620 A except that there is a difference in material.

The photoreceptor is not particularly limited, but preferable examples thereof include a photoreceptor including a conductive support, a photosensitive layer disposed on the conductive support, and a protective layer disposed on the photosensitive layer as an outermost layer. Hereinafter, an electrophotographic photoreceptor having such a configuration will be described in detail.

(Conductive Support)

The conductive support is a member that supports the photosensitive layer and has conductivity. The shape of the conductive support is usually cylindrical. Preferable examples of the conductive support include: a plastic film having a metal drum or sheet, or a laminated metal foil; a plastic film having a film of a vapor-deposited conductive material; a metal member or a plastic film having a conductive layer formed by applying a conductive material or a coating material containing the conductive material and a binder resin, and paper. Preferable examples of the metal include aluminum, copper, chromium, nickel, zinc, and stainless steel. preferable examples of the conductive material include the metal, indium oxide, and tin oxide.

(Photosensitive Layer)

The photosensitive layer is a layer for forming an electrostatic latent image of a desired image on a surface of the photoreceptor by exposure described later. The photosensitive layer may be a single layer or may include a plurality of laminated layers. Preferable examples of the photosensitive layer include a single layer containing a charge transporting material and a charge generating material, and a laminate of a charge transporting layer containing a charge transporting material and a charge generating layer containing a charge generating material.

(Protective Layer) The protective layer is a layer for improving mechanical strength of a surface of the photoreceptor and improving scratch resistance and abrasion resistance. Preferable examples of the protective layer include a layer formed of a polymerized and cured product of a composition containing a polymerizable monomer.

(Other Components)

The photoreceptor may further include a component other than the above conductive support, photosensitive layer, and protective layer. Preferable example of the other component include an intermediate layer. The intermediate layer is, for example, a layer disposed between the conductive support and the photosensitive layer and having a barrier function and an adhesion function. Therefore, as a preferable embodiment of a photoreceptor used in the present invention, for example, a photoreceptor includes a conductive support, an intermediate layer disposed on the conductive support, a photosensitive layer disposed on the intermediate layer, and a protective layer disposed on the photosensitive layer as an outermost layer.

(Outermost Layer)

Here, the outermost layer of the photoreceptor refers to a layer disposed on an outermost portion in contact with toner. The outermost layer is not particularly limited, but is preferably the above protective layer. For example, when the photoreceptor includes the conductive support, the photosensitive layer, and the protective layer, and the protective layer is the outermost layer, the photoreceptor has a laminated structure formed by laminating the conductive support, the photosensitive layer, and the protective layer in this order and disposing the protective layer on an outermost portion in contact with toner.

In an embodiment of the present invention, the outermost layer is formed of a polymerized and cured product of a composition containing a polymerizable monomer and an inorganic filler (hereinafter, also referred to as an outermost layer forming composition).

Hereinafter, the components of the outermost layer will be described in detail.

[Inorganic Filler]

The outermost layer forming composition contains an inorganic filler. Here, the inorganic filler refers to a particle in which at least a surface is formed of an inorganic substance. The inorganic filler has a function of improving abrasion resistance of the outermost layer. Furthermore, the inorganic filler has a function of improving removability of a residual toner to improve cleaning performance and reducing abrasion of a photoreceptor and a cleaning blade.

Hereinafter, a surface treatment agent having a silicone chain is also simply referred to as "silicone surface treatment agent", and surface treatment with "silicone surface treatment agent" is also simply referred to as "silicone surface treatment".

A surface treatment agent having a polymerizable group is also simply referred to as "reactive surface treatment agent", and surface treatment with "reactive surface treatment agent" is also simply referred to as "reactive surface treatment".

An inorganic filler that has been subjected to at least one of "silicone surface treatment" and "reactive surface treatment" may be simply referred to as "surface-treated particles" collectively.

The inorganic filler is not particularly limited, but preferably contains metal oxide particles. Here, the metal oxide particles refer to particles in which at least surfaces (in a case of surface-treated particles, surfaces of untreated metal oxide particles which are untreated base particles) are formed of metal oxide.

The shapes of the particles are not particularly limited, and may be any shape such as a powdery shape, a spherical shape, a rod shape, a needle shape, a plate shape, a columnar shape, an irregular shape, a scaly shape, or a spindle shape.

The metal oxide constituting the metal oxide particles is not particularly limited, and examples thereof include silica (silicon oxide), magnesium oxide, zinc oxide, lead oxide, alumina (aluminum oxide), tantalum oxide, indium oxide, bismuth oxide, yttrium oxide, cobalt oxide, copper oxide, manganese oxide, selenium oxide, iron oxide, zirconium oxide, germanium oxide, tin oxide, titanium dioxide, niobium oxide, molybdenum oxide, vanadium oxide, copper aluminum oxide, and antimony-doped tin oxide. Among these compounds, silica ($SiO_2$) particles, tin oxide ($SnO_2$) particles, titanium dioxide ($TiO_2$) particles, and antimony-doped tin oxide ($SnO_2$—Sb) particles are preferable, and tin oxide particles are more preferable. These metal oxide particles can be used singly or in combination of two or more types thereof.

The metal oxide particles are preferably composite particles each having a core-shell structure including a core material (core) and an outer shell (shell) formed of metal oxide. When such particles are used, by selecting a core material (core) having a small difference in refractive index from a polymerizable monomer, transmittance of an active energy ray (particularly an ultraviolet ray) used for curing the outermost layer is improved, film strength of the outermost layer after curing is improved, and abrasion of the outermost layer is further reduced. Furthermore, by selecting a material constituting an outer shell (shell) and controlling the shape of the outer shell (shell), a surface treatment effect in surface-treated particles described later can be further enhanced. As a result, an effect of reducing abrasion of the photoreceptor and the cleaning blade and an effect of suppressing image defects can be further improved, and transferability onto an uneven sheet can be further improved. A material constituting the core material (core) of the composite particle is not particularly limited, and examples thereof include an insulating material such as barium sulfate ($BaSO_4$), alumina ($Al_2O_3$), or silica ($SiO_2$). Among these compounds, barium sulfate and silica are preferable from a viewpoint of securing light transmittance of the outermost layer. A material constituting the outer shell (shell) of the composite particle is similar to those exemplified as the metal oxide constituting the metal oxide particles. Preferable examples of the composite particle having a core-shell structure include a composite particle having a core-shell structure including a core material formed of barium sulfate and an outer shell formed of tin oxide. Note that a ratio between the number average primary particle diameter of the core material and the thickness of the outer shell only needs to be appropriately set according to the types of core material and outer shell used and a combination thereof so as to obtain a desired surface treatment effect.

A lower limit value of the number average primary particle diameter of the inorganic filler is not particularly limited, but is preferably 1 nm or more, more preferably 5 nm or more, still more preferably 10 nm or more, further still more preferably 50 nm or more, and particularly preferably 80 nm or more. Within this range, cleaning performance is further improved, and abrasion of the photoreceptor is further reduced. An upper limit value of the number average primary particle diameter of the inorganic filler is not particularly limited, but is preferably 700 nm or less, more preferably 500 nm or less, still more preferably 300 nm or less, further still more preferably 200 nm or less, and particularly preferably 150 nm or less. Within this range, cleaning performance is further improved, and abrasion of the cleaning blade is further reduced. A reason for these is presumed to be that by controlling the number average primary particle diameter so as to be within the above range, the average projection height $R_1$ of the outermost layer and the average distance $R_2$ between projections of a projection structure due to a ridge of the inorganic filler in the outermost layer can be controlled so as to be within optimum ranges. Therefore, as a preferable embodiment of the present invention, for example, the number average primary particle diameter of the inorganic filler is 80 nm or more and 200 nm or less.

Note that here, the number average primary particle diameter of the inorganic filler is measured by the following method. First, a photograph of the outermost layer taken with a scanning electron microscope (manufactured by JEOL Ltd.) and enlarged with a magnification of 10000 is taken into a scanner. Subsequently, 300 particle images excluding aggregated particles are randomly extracted from the obtained photograph image and binarized using an automatic image processing and analysis system LUZEX (registered trademark) AP software Ver. 1.32 (manufactured by Nireco Co., Ltd.) to calculate a horizontal direction Feret diameter of each of the particle images. Then, an average value of the horizontal direction Feret diameters of the particle images is calculated to be taken as a number average primary particle diameter. Here, the horizontal direction Feret diameter refers to the length of a side of a circumscribed rectangle parallel to an x axis when the particle images are binarized. The number average primary particle diameter of the inorganic filler is measured for an inorganic filler (untreated base particles) not containing a chemical species having a polymerizable group or a chemical species (covering layer) derived from a surface treatment agent in an inorganic filler having a polymerizable group described later and the surface-treated particles.

The inorganic filler in the outermost layer forming composition preferably has a polymerizable group. By inclusion of a polymerizable group in the inorganic filler in the outermost layer forming composition, abrasion of the photoreceptor is further reduced. A reason for this is presumed to be that the inorganic filler having a polymerizable group and the polymerizable monomer are chemically bonded to each other in a cured product constituting the outermost layer, and the film strength of the outermost layer is improved. The type of polymerizable group is not particularly limited, but a radically polymerizable group is preferable. A method for introducing a polymerizable group is not particularly limited, but as described later, a method for subjecting the inorganic filler to surface treatment with a surface treatment agent having a polymerizable group is preferable.

It can be confirmed by thermal weight/differential heat (TG/DTA) measurement, observation with a scanning electron microscope (SEM) or a transmission electron microscope (TEM), analysis by energy dispersive X-ray spectroscopy (EDX), or the like that the inorganic filler in the outermost layer forming composition has a polymerizable group and that the inorganic filler in the outermost layer has a group derived from a polymerizable group.

The preferable content of the inorganic filler in the outermost layer forming composition is described in the description of a method for manufacturing an electrophotographic photoreceptor described later.

Surface treatment with surface treatment agent having silicone chain (silicone surface treatment agent)

The inorganic filler is preferably surface-treated (silicone surface-treated) with a surface treatment agent having a silicone chain (silicone surface treatment agent).

The silicone surface treatment agent preferably has a structural unit represented by the following formula (1).

[Chemical formula 1]

Formula (1)

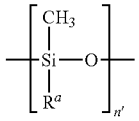

In formula (1), $R^a$ represents a hydrogen atom or a methyl group, and n' represents an integer of 3 or more.

The silicone surface treatment agent may be a silicone surface treatment agent having a silicone chain in a main chain (main chain type silicone treatment agent) or a silicone surface treatment agent having a silicone chain in a side chain (side chain type silicone treatment agent), but is preferably a side chain type silicone treatment agent. That is, the inorganic filler is preferably surface-treated with a side chain type silicone surface treatment agent. The side chain type silicone treatment agent has a function of further reducing adhesion and friction between the external additive and the inorganic filler, further improving removability of a residual toner, thereby further improving cleaning performance, and further reducing particularly abrasion of the cleaning blade. A reason for this is presumed as follows. The side chain type silicone surface treatment agent has a bulky structure, can further increase the density of a silicone chain on the inorganic filler, and can make surfaces of the metal oxide particles hydrophobic efficiently. As a result, adhesion and friction between the external additive and the inorganic filler can be significantly reduced.

The side chain type silicone surface treatment agent is not particularly limited, but preferably has a silicone chain in a side chain of a polymer main chain and further has a surface treatment functional group. Examples of the surface treatment functional group include a carboxylic acid group, a hydroxy group, —$R^d$—COOH ($R^d$ represents a divalent hydrocarbon group), a halogenated silyl group, and a group that can be bonded to conductive metal oxide particles, such as an alkoxysilyl group. Among these groups, a carboxylic acid group, a hydroxy group, and an alkoxysilyl group are preferable, and a hydroxy group and an alkoxysilyl group are more preferable.

The side chain type silicone surface treatment agent preferably has a poly(meth)acrylate main chain or a silicone main chain as a polymer main chain from a viewpoint of further reducing abrasion of the cleaning blade while maintaining the effect of the present invention.

The silicone chain in a side chain or a main chain preferably has a dimethylsiloxane structure as a repeating unit. The number of the repeating units is preferably 3 to 100, more preferably 3 to 50, and still more preferably 3 to 30.

The weight average molecular weight of the silicone surface treatment agent is not particularly limited, but is preferably 1,000 or more and 50,000 or less. Note that the weight average molecular weight of the silicone surface treatment agent can be measured using gel permeation chromatography (GPC).

The silicone surface treatment agent may be a synthetic product or a commercially available product. Specific examples of the commercially available main chain type silicone surface treatment agent include KF-99 and KF-9901 (manufactured by Shin-Etsu Chemical Co., Ltd.). Specific examples of the commercially available side chain type silicone surface treatment agent having a silicone chain in a side chain of a poly(meth)acrylate main chain include SYMAC (registered trademark) US-350 (manufactured by Toagosei Co., Ltd.), and KP-541, KP-574, and KP-578 (manufactured by Shin-Etsu Chemical Co., Ltd.). Specific examples of the commercially available side chain type silicone surface treatment agent having a silicone chain in a side chain of a silicone main chain include KF-9908 and KF-9909 (manufactured by Shin-Etsu Chemical Co., Ltd.). A silicone surface treatment agent can be used singly or in combination of two or more types thereof.

A surface treatment method with a silicone surface treatment agent is not particularly limited as long as being able to attach (or bond) the silicone surface treatment agent to a surface of the inorganic filler. Generally, such methods are roughly classified into two types, that is, a wet treatment method and a dry treatment method, and either of these may be used.

Note that when the inorganic filler after a reactive surface treatment described later is subjected to silicone surface treatment, a surface treatment method with a silicone surface treatment agent only needs to be able to attach (or bond) the silicone surface treatment agent onto a surface of the inorganic filler or the reactive surface treatment agent.

The wet treatment method is a method for attaching (or bonding) a silicone surface treatment agent onto a surface of an inorganic filler by dispersing the inorganic filler and the silicone surface treatment agent in a solvent. The method is preferably a method for dispersing an inorganic filler and a silicone surface treatment agent in a solvent and drying the obtained dispersion to remove the solvent, and more preferably a method for further performing heat treatment thereafter and causing a reaction between the silicone surface treatment agent and the inorganic filler to attach (bond) the silicone surface treatment agent onto a surface of the inorganic filler. In addition, after the silicone surface treatment agent and the inorganic filler are dispersed in the solvent, the obtained dispersion may be wet-ground to make the inorganic filler finer and simultaneously to promote surface treatment.

A disperser for dispersing an inorganic filler and a silicone surface treatment agent in a solvent is not particularly limited, and a known means can be used. Examples thereof include a general disperser such as a homogenizer, a ball mill, or a sand mill.

The solvent is not particularly limited, and a known solvent can be used. Preferable examples thereof include an alcohol-based solvent such as methanol, ethanol, n-propanol, isopropanol, n-butanol, sec-butanol (2-butanol), tert-butanol, or benzyl alcohol, and an aromatic hydrocarbon-based solvent such as toluene or xylene.

These solvents may be used singly or in combination of two or more types thereof. Among these solvents, methanol, 2-butanol, toluene, and a mixed solvent of 2-butanol and toluene are more preferable, and 2-butanol is still more preferable.

Dispersing time is not particularly limited, but is preferably one minute or more and 600 minutes or less, more preferably 10 minutes or more and 360 minutes or less, and still more preferably 30 minute or more and 120 minutes or less.

A method for removing a solvent is not particularly limited, and a known method can be used. Examples thereof include a method using an evaporator and a method for volatilizing a solvent at room temperature. Among these methods, a method for volatilizing a solvent at room temperature is preferable.

A heating temperature is not particularly limited, but is preferably 50° C. or higher and 250° C. or lower, more preferably 70° C. or higher and 200° C. or lower, and still more preferably 80° C. or higher and 150° C. or lower. Heating time is not particularly limited, but is preferably one minute or more and 600 minutes or less, more preferably 10 minutes or more and 300 minutes or less, and still more preferably 30 minute or more and 90 minutes or less. Note that a heating method is not particularly limited, and a known method can be used.

The dry treatment method is a method for attaching (or bonding) a silicone surface treatment agent onto a surface of an inorganic filler by mixing and kneading the silicone surface treatment agent and the inorganic filler without using a solvent. The method may be a method for mixing and kneading a silicone surface treatment agent and an inorganic filler, then further performing heat treatment, and causing a reaction between the silicone surface treatment agent and the inorganic filler to attach (or bond) the silicone surface treatment agent onto a surface of the inorganic filler. When the inorganic filler and the silicone surface treatment agent are mixed and kneaded, the inorganic filler and the silicone surface treatment agent may be dry-ground to make the inorganic filler finer and simultaneously to promote surface treatment.

The amount of the silicone surface treatment agent used is preferably 0.1 parts by mass or more, more preferably 1 part by mass or more, and still more preferably 2 parts by mass or more with respect to 100 parts by mass of the inorganic filler before silicone surface treatment (inorganic filler after reactive surface treatment if the inorganic filler after reactive surface treatment described later is subjected to silicone surface treatment). Within this range, cleaning performance is further improved, and abrasion of the cleaning blade is further reduced. The amount of the silicone surface treatment agent used is preferably 100 parts by mass or less, more preferably 10 parts by mass or less, and still more preferably 5 parts by mass or less with respect to 100 parts by mass of the inorganic filler before silicone surface treatment (inorganic filler after reactive surface treatment if the inorganic filler after reactive surface treatment described later is subjected to silicone surface treatment). Within this range, a decrease in film strength of the outermost layer due to the unreacted silicone surface treatment agent is suppressed, and abrasion of the photoreceptor is further reduced.

It can be confirmed by thermal weight/differential heat (TG/DTA) measurement, observation with a scanning electron microscope (SEM) or a transmission electron microscope (TEM), analysis by energy dispersive X-ray spectroscopy (EDX), or the like that the unreacted inorganic filler and the inorganic filler after reactive surface treatment have been subjected to silicone surface treatment.

Surface treatment method with surface treatment agent having polymerizable group (reactive surface treatment agent)

As described above, the inorganic filler in the outermost layer forming composition preferably has a polymerizable group. A method for introducing a polymerizable group is not particularly limited, but is preferably a method for performing reactive surface treatment.

That is, the inorganic filler has been preferably subjected to surface treatment (reactive surface treatment) with a surface treatment agent having a polymerizable group (reactive surface treatment agent). The polymerizable group is carried on a surface of the conductive metal oxide particles by reactive surface treatment, and as a result, the inorganic filler has a polymerizable group. Note that the inorganic filler is present as a structure having a group derived from a polymerizable group in the outermost layer, and therefore, as a preferable embodiment of the present invention, for example, the inorganic filler has a group derived from a polymerizable group.

The reactive surface treatment agent has a polymerizable group and a surface treatment functional group. The type of polymerizable group is not particularly limited, but a radically polymerizable group is preferable. Here, the radically polymerizable group represents a radically polymerizable group having a carbon-carbon double bond. Examples of the radically polymerizable group include a vinyl group and a (meth)acryloyl group. Among these groups, a methacryloyl group is preferable. The surface treatment functional group represents a group having reactivity to a polar group such as a hydroxy group present on surfaces of the conductive metal oxide particles. Examples of the surface treatment functional group include a carboxylic acid group, a hydroxy group, —$R^{d1}$—COOH ($R^{d1}$ represents a divalent hydrocarbon group), a halogenated silyl group, and an alkoxysilyl group. Among these groups, a halogenated silyl group and an alkoxysilyl group are preferable.

The reactive surface treatment agent is preferably a silane coupling agent having a radically polymerizable group, and examples thereof include compounds represented by the following formulas S-1 to S-33.

[Chemical formula 2]

$CH_2{=}CHSi(CH_3)(OCH_3)_2$ S-1:

$CH_2{=}CHSi(OCH_3)_3$ S-2:

$CH_2{=}CHSiCl_2$ S-3:

$CH_2{=}CHCOO(CH_2)_2Si(CH_3)(OCH_2)_2$ S-4:

$CH_2{=}CHCOO(CH_2)_2Si(OCH_3)_3$ S-5:

$CH_2{=}CHCOO(CH_2)_2Si(OC_3H_3)(OCH_3)_2$ S-6:

$CH_2{=}CHCOO(CH_2)_2Si(OCH_3)_3$ S-7:

$CH_2{=}CHCOO(CH_2)_2Si(CH_3)Cl_2$ S-8:

$CH_2{=}CHCOO(CH_2)_2SiCl_3$ S-9:

$CH_2{=}CHCOO(CH_2)_3Si(CH_3)Cl_2$ S-10:

$CH_2{=}CHCOO(CH_2)_3SiCl_3$ S-11:

$CH_2{=}C(CH_3)COO(CH_2)_2Si(CH_3)(OCH_3)_2$ S-12:

$CH_2{=}C(CH_3)COO(CH_2)_2Si(OCH_3)_3$ S-13:

$CH_2{=}C(CH_3)COO(CH_2)_3Si(CH_3)(OCH_2)_2$ S-14:

$CH_2{=}C(CH_3)COO(CH_2)_2Si(OCH_3)_3$ S-15:

$CH_2{=}C(CH_3)COO(CH_2)_2Si(CH_3)Cl_2$ S-16:

$CH_2{=}C(CH_3)COO(CH_2)_2SiCl_2$ S-17:

$CH_2{=}C(CH_3)COO(CH_2)_3Si(CH_3)Cl_2$ S-18:

$CH_2{=}C(CH_3)COO(CH_2)_2SiCl_3$ S-19:

$CH_2{=}CHSi(C_2H_5)(OCH_3)_2$ S-20:

$CH_2{=}C(CH_3)Si(OCH_3)_3$ S-21:

$CH_2{=}C(CH_3)Si(OC_3H_3)_3$ S-22:

$CH_2{=}CHSi(OCH_3)_2$ S-23:

$CH_2{=}C(CH_3)Si(CH_3)(OCH_3)_2$ S-24:

$CH_2{=}CHSi(CH_3)Cl_2$ S-25:

$CH_2{=}CHCOOSi(OCH_2)_3$ S-26:

$CH_2{=}CHCOOSi(OC_2H_5)_3$ S-27:

$CH_2{=}C(CH_3)COOSi(OCH_3)_3$ S-28:

$CH_2{=}C(CH_3)COOSi(OC_2H_5)_3$ S-29:

$CH_2{=}C(CH_3)COO(CH_2)_3Si(OC_2H_5)_3$ S-30:

$CH_2{=}CHCOO(CH_2)_2Si(CH_3)_2(OCH_3)$ S-31:

$CH_2{=}C(CH_3)COO(CH_2)_3Si(OCH_3)_3$ S-32:

S-33:

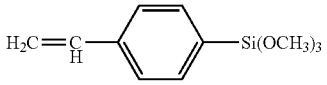

The reactive surface treatment agent may be a synthetic product or a commercially available product. Specific examples of the commercially available products include KBM-502, KBM-503, KBE-502, KBE-503, and KBM-5103 (manufactured by Shin-Etsu Chemical Co., Ltd.). The reactive surface treatment agent can be used singly or in combination of two or more types thereof.

When both silicone surface treatment and reactive surface treatment are performed, silicone surface treatment is preferably performed after reactive surface treatment. By performing surface treatment in this order, abrasion resistance of the outermost layer is further improved. A reason for this is that the silicone chain having an oil repellent effect does not prevent contact of the reactive surface treatment agent with a surface of the inorganic filler, and therefore introduction of a polymerizable group into the inorganic filler is more efficiently performed.

A method of reactive surface treatment is not particularly limited, and a similar method to the method described in silicone surface treatment can be adopted except that a reactive surface treatment agent is used. In addition, a known surface treatment technique for metal oxide particles may be used.

Here, when a wet treatment method is used, a similar solvent to that used in the method described in silicone surface treatment can be preferably used. However, methanol, toluene, and a mixed solvent of methanol and toluene are more preferable, and a mixed solvent of methanol and toluene is still more preferable.

Examples of a method for removing a solvent include a method similar to the method described in silicone surface treatment. However, among these methods, a method using an evaporator is preferable.

The amount of the reactive surface treatment agent used is preferably 0.5 parts by mass or more, more preferably 1 part by mass or more, and still more preferably 1.5 parts by mass or more with respect to 100 parts by mass of the inorganic filler before reactive surface treatment (inorganic filler after silicone surface treatment if the inorganic filler after silicone surface treatment described above is subjected to reactive surface treatment). Within this range, film strength of the outermost layer is improved, and abrasion of the photoreceptor is further reduced. The amount of the reactive surface treatment agent used is preferably 15 parts by mass or less, more preferably 10 parts by mass or less, and still more preferably 8 parts by mass or less with respect to 100 parts by mass of the inorganic filler before reactive surface treatment (inorganic filler after silicone surface treatment if the inorganic filler after silicone surface treatment described above is subjected to reactive surface treatment). Within this range, the amount of the reactive surface treatment agent is not excessive with respect to the number of hydroxy groups on surfaces of the particles and is in a more appropriate range, a decrease in the film strength of the outermost layer by the unreacted reactive surface treatment agent is suppressed to improve the film strength of the outermost layer, and abrasion of the photoreceptor is further reduced.

<Polymerizable Monomer>

The outermost layer forming composition contains a polymerizable monomer. Here, the polymerizable monomer represents a compound that has a polymerizable group and is polymerized (cured) by irradiation with an active energy ray such as an ultraviolet ray, a visible ray, or an electron beam, or by addition of energy such as heating to become a binder resin of the outermost layer. Note that the polymerizable monomer here does not include the above reactive surface treatment agent. When a polymerizable silicone compound or a polymerizable perfluoropolyether compound is used as a lubricant described later, the polymerizable monomer does not include the polymerizable silicone compound or the polymerizable perfluoropolyether compound, either.

The type of the polymerizable group included in the polymerizable monomer is not particularly limited, but a radically polymerizable group is preferable. Here, the radically polymerizable group represents a radically polymerizable group having a carbon-carbon double bond. Examples of the radically polymerizable group include a vinyl group and a (meth)acryloyl group, and a methacryloyl group is preferable. When the polymerizable group is a (meth)acryloyl group, abrasion resistance of the outermost layer is improved, and abrasion of the photoreceptor is further reduced. A reason for the improvement of the abrasion resistance of the outermost layer is presumed to be that efficient curing with a small amount of light or in a short time is possible.

Examples of the polymerizable monomer include a styrene-based monomer, a (meth)acrylic monomer, a vinyl toluene-based monomer, a vinyl acetate-based monomer, and an N-vinylpyrrolidone-based monomer. These polymerizable monomers can be used singly or in combination of two or more types thereof.

The number of polymerizable groups in one molecule of the polymerizable monomer is not particularly limited, but is preferably 2 or more, and more preferably 3 or more. Within this range, abrasion resistance of the outermost layer is improved, and abrasion of the photoreceptor is further reduced. A reason for this is presumed to be that the crosslinking density of the outermost layer is increased and the film strength is further improved. The number of polymerizable groups in one molecule of the polymerizable monomer is not particularly limited, but is preferably 6 or less, more preferably 5 or less, and still more preferably 4 or less. Within this range, uniformity of the outermost layer is enhanced A reason for this is presumed to be that the crosslinking density is at a certain level or low, and curing shrinkage hardly occurs. The number of polymerizable groups in one molecule of the polymerizable monomer is most preferably 3 from these viewpoints.

Specific examples of the polymerizable monomer are not particularly limited, but include the following compounds M1 to M11. Among these compounds, the following compound M2 is particularly preferable. In each of the following formulas, R represents an acryloyl group ($CH_2{=}CHCO{-}$), and R' represents a methacryloyl group ($CH_2{=}C(CH_3)CO{-}$).

[Chemical formula 3]

M1

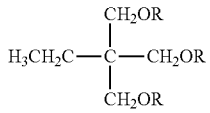

M2

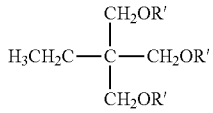

M3

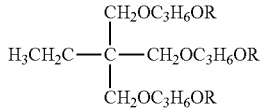

M4

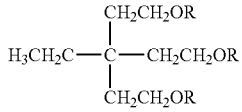

M5

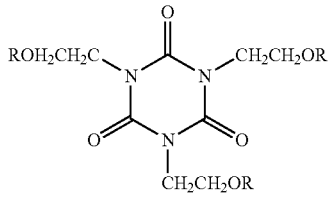

M6

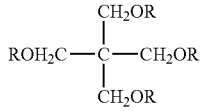

M7

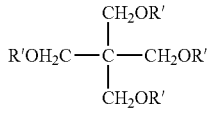

M8

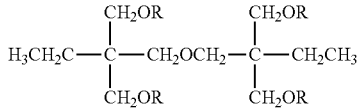

M9

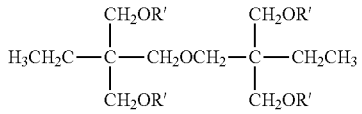

M10

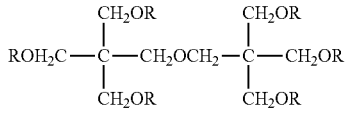

-continued

M11

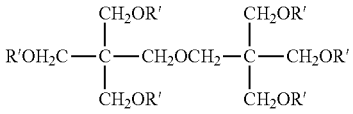

The polymerizable monomer may be a synthetic product or a commercially available product. The polymerizable monomer may be used singly or in combination of two or more types thereof.

The preferable content of the polymerizable monomer in the outermost layer forming composition is described in the description of a method for manufacturing an electrophotographic photoreceptor described later.

<Polymerization Initiator>

The outermost layer forming composition preferably further contains a polymerization initiator. The polymerization initiator is used in a process of manufacturing a cured resin (binder resin) obtained by polymerizing the polymerizable monomer. The polymerization initiator may be a thermal polymerization initiator or a photopolymerization initiator, but is preferably a photopolymerization initiator. When the polymerizable monomer is a radically polymerizable monomer, the polymerization initiator is preferably a radical polymerization initiator. The radical polymerization initiator is not particularly limited, and a known radical polymerization initiator can be used. Examples thereof include an alkylphenone-based compound and a phosphine oxide-based compound. Among these compounds, a compound having an α-aminoalkylphenone structure or an acylphosphine oxide structure is preferable, and the compound having an acylphosphine oxide structure is more preferable. Examples of the compound having an acylphosphine oxide structure include IRGACURE (registered trademark) 819 (bis(2,4,6-trimethylbenzoyl) phenylphosphine oxide) (manufactured by BASF Japan Ltd.).

The polymerization initiator may be used singly or in combination of two or more types thereof.

The preferable content of the polymerization initiator in the outermost layer forming composition is described in the description of a method for manufacturing an electrophotographic photoreceptor described later.

[Other Component]

The outermost layer forming composition may further contain a component other than the above components. Examples of the other component are not particularly limited, but include a lubricant when the outermost layer is a protective layer. The charge transporting material is not particularly limited, and a known material can be used, and examples thereof include a triarylamine derivative. The lubricant is not particularly limited, and a known lubricant can be used. Examples thereof include a polymerizable silicone compound and a polymerizable perfluoropolyether compound.

(Characteristics of Outermost Layer)

In an embodiment of the present invention, a surface of the outermost layer has a projection structure due to a ridge of the inorganic filler. Here, the "projection structure due to a ridge of an inorganic filler" means a projection structure formed by an exposed inorganic filler.

It can be confirmed by visually observing a photographic image of a surface of the outermost layer taken using a scanning electron microscope (SEM) "JSM-7401F" (manufactured by JEOL Ltd.) that the projection structure present on a surface of the outermost layer is due to a ridge of the inorganic filler.

The average projection height $R_1$ of the outermost layer is not particularly limited, but is preferably 1 nm or more, more preferably 15 nm or more, and still more preferably 25 nm or more. Within this range, cleaning performance is further improved, and abrasion of the photoreceptor is further reduced. A reason for this is presumed to be that an increase in the average projection height $R_1$ of the outermost layer further reduces abrasion of the outermost layer by the cleaning blade, and further increases a possibility of contact between a toner and the outermost layer due to contact between the external additive and the inorganic filler. The average projection height $R_1$ of the outermost layer is not particularly limited, but is preferably 100 nm or less, more preferably 55 nm or less, and still more preferably 35 nm or less (lower limit: 0 nm). Within this range, cleaning performance is further improved, and abrasion of the cleaning blade is further reduced. A reason for this is presumed to be that abrasion of the cleaning blade by the inorganic filler in the outermost layer is further reduced, and that contact between the cleaning blade and a resin portion of a polymerized and cured product constituting the outermost layer also sufficiently occurs.

The average projection height $R_1$ of the outermost layer can be calculated by three-dimensionally measuring a surface of the outermost layer using a three-dimensional roughness analysis scanning electron microscope "ERA-600FE" (manufactured by Elionix Co., Ltd.), calculating an average height of outline curve elements in three-dimensional analysis, and taking the calculated value as the average projection height $R_1$ of the outermost layer.

The average distance $R_2$ between projections of a projection structure due to a ridge of the inorganic filler in the outermost layer is equal to or lower than $R_2'$ that is a maximum value of an average distance between projections of the projection structure due to a ridge of the inorganic filler in the outermost layer calculated from a relationship with $R_1$ and $R_3$, and is 250 nm or less as described above. When the average distance $R_2$ between projections of a projection structure due to a ridge of the inorganic filler in the outermost layer exceeds 250 nm, cleaning performance is insufficient, and the abrasion amounts of the photoreceptor and the cleaning blade are excessive. Furthermore, transferability onto an uneven sheet is insufficient. Here, the average distance $R_2$ between projections of a projection structure due to a ridge of the inorganic filler in the outermost layer is preferably 240 nm or less, more preferably 225 nm or less, still more preferably 200 nm or less, and particularly preferably 150 nm or less. Within this range, cleaning performance is further improved, and abrasion of the cleaning blade is further reduced. A reason for this is presumed to be that a toner tends to come into contact with the inorganic filler in the outermost layer, thereby reducing adhesion and friction between the toner and the outermost layer, thereby reducing a load at the time of cleaning. The average distance $R_2$ between projections of a projection structure due to a ridge of the inorganic filler in the outermost layer is not particularly limited as long as being more than 0 nm, but is preferably 120 nm or more from a viewpoint of productivity.

The average distance $R_2$ between projections of a projection structure due to a ridge of the inorganic filler in the outermost layer is calculated as follows. First, a photographic image of a surface of the outermost layer taken using a scanning electron microscope (SEM) ("JSM-7401F" manufactured by JEOL Ltd.) is captured by a scanner. A portion of the inorganic filler of the photographic image is binarized using an image processing analyzer ("LUZEX AP" manufactured by Nireco Co., Ltd.), and a two-point distance of the inorganic filler is calculated for 50 points. Then, an average value of these distances is calculated, and this average value is taken as the average distance $R_2$ between projections of a projection structure due to a ridge of the inorganic filler in the outermost layer.

Here, the average projection height $R_1$ of the outermost layer and the average distance $R_2$ between projections of a projection structure due to a ridge of the inorganic filler in the outermost layer can be controlled by the type and content of inorganic filler, the type and content of polymerizable monomer, whether surface treatment has been performed, the type of surface treatment agent, surface treatment conditions, the type of untreated base particles, and the like.

(Film Thickness of Outermost Layer)

The thickness of the outermost layer can be appropriately set to a preferable value according to the type of photoreceptor, and is not particularly limited, but is preferably 0.2 μm or more and 15 μm or less, and more preferably 0.5 μm or more and 10 μm or less in a general photoreceptor.

(Method for Manufacturing Electrophotographic Photoreceptor)

The electrophotographic photoreceptor used for an embodiment of the present invention can be manufactured by a known method for manufacturing an electrophotographic photoreceptor without particular limitation except that an outermost layer forming coating solution described later is used. Among these methods, the electrophotographic photoreceptor is preferably manufactured by a method including a step of applying an outermost layer forming coating solution to a surface of a photosensitive layer formed on a conductive support, and a step of irradiating the applied outermost layer forming coating solution with an active energy ray or heating the applied outermost layer forming coating solution to polymerize a polymerizable monomer in the outermost layer forming coating solution, and more preferably manufactured by a method including a step of applying an outermost layer forming coating solution and a step of irradiating the applied outermost layer forming coating solution with an active energy ray to polymerize a polymerizable monomer in the outermost layer forming coating solution.

The outermost layer forming coating solution contains an outermost layer forming composition containing a polymerizable monomer and an inorganic filler. The outermost layer forming composition preferably further contains a polymerization initiator, and may further contain a component other than these components. The outermost layer forming coating solution preferably contains an outermost layer forming composition and a dispersion medium. Note that here, the outermost layer forming composition does not include a compound used only as a dispersion medium.

The dispersion medium is not particularly limited, and a known dispersion medium can be used. Examples thereof include methanol, ethanol, n-propyl alcohol, isopropyl alcohol, n-butanol, tert-butanol, 2-butanol (sec-butanol), benzyl alcohol, toluene, xylene, methyl ethyl ketone, cyclohexane, ethyl acetate, butyl acetate, methyl cellosolve, ethyl cellosolve, tetrahydrofuran, 1,3-dioxane, 1,3-dioxolane, pyridine, and diethylamine. The dispersion medium may be used singly or in combination of two or more types thereof.

The content of the dispersion medium with respect to the total mass of the outermost layer forming coating solution is not particularly limited, but is preferably 1% by mass or more and 99% by mass or less, more preferably 40% by mass or more and 90% by mass or less, and still more preferably 50% by mass or more and 80% by mass or less.

The content of the inorganic filler in the outermost layer forming composition is not particularly limited, but is preferably 20% by mass or more, more preferably 30% by mass or more, and still more preferably 40% by mass or more with respect to the total mass of the outermost layer forming composition. Within this range, abrasion resistance of the outermost layer is improved, and abrasion of the photoreceptor is further reduced. With an increase in the content of the inorganic filler, an effect caused by the particles is improved, cleaning performance is improved, and abrasion of the cleaning blade is further reduced. The content of the inorganic filler in the outermost layer forming composition is not particularly limited, but is preferably 90% by mass or less, more preferably 80% by mass or less, and still more preferably 70% by mass or less with respect to the total mass of the outermost layer forming composition. Within this range, the content of the polymerizable monomer in the outermost layer forming composition is relatively large. Therefore, the crosslinking density of the outermost layer is increased, abrasion resistance is improved, and abrasion of the photoreceptor is further reduced. Furthermore, contact between the cleaning blade and a resin portion of a polymerized and cured product constituting the outermost layer is sufficiently obtained, and cleaning performance is improved. Furthermore, as a result, abrasion of the cleaning blade is further reduced.

A content ratio by mass of the polymerizable monomer with respect to the inorganic filler (the mass of the polymerizable monomer/the mass of the inorganic filler in the outermost layer forming composition) in the outermost layer forming composition is not particularly limited, but is preferably 0.1 or more, more preferably 0.2 or more, and still more preferably 0.4 or more. Within this range, the content of the polymerizable monomer in the outermost layer forming composition is relatively large. Therefore, the crosslinking density of the outermost layer is increased, abrasion resistance is improved, and abrasion of the photoreceptor is further reduced. Furthermore, contact between the cleaning blade and a resin portion of a polymerized and cured product constituting the outermost layer is sufficiently obtained, and cleaning performance is improved. Furthermore, as a result, abrasion of the cleaning blade is further reduced. A content ratio by mass of the polymerizable monomer with respect to the inorganic filler in the outermost layer forming composition is not particularly limited, but is preferably 10 or less, more preferably 2 or less, and still more preferably 1.5 or less. Within this range, abrasion resistance of the outermost layer is improved, and abrasion of the photoreceptor is further reduced. With an increase in the content of the inorganic filler, an effect caused by the particles is improved, cleaning performance is improved, and abrasion of the cleaning blade is further reduced.

When the outermost layer forming composition contains a polymerization initiator, the content thereof is not particularly limited, but is preferably 0.1 parts by mass or more, more preferably 1 part by mass or more, and still more preferably 5 parts by mass or more with respect to 100 parts by mass of the polymerizable monomer. The content of the polymerization initiator in the outermost layer forming composition is not particularly limited, but is preferably 30 parts by mass or less, and more preferably 20 parts by mass or less with respect to 100 parts by mass of the polymerizable monomer. Within this range, the crosslinking density of the outermost layer is increased, abrasion resistance of the outermost layer is improved, and abrasion of the photoreceptor is further reduced.

Note that the content (% by mass) of the inorganic filler, the cured product of the polymerizable monomer, and optionally used polymerization initiator and other components (including cured products thereof if being polymerizable) with respect to the total mass of the outermost layer is almost the same as the content (% by mass) of the inorganic filler, the polymerizable monomer, and optionally used polymerization initiator and other components with respect to the total mass of the outermost layer forming composition.

A method for preparing the outermost layer forming coating solution is not particularly limited, either. A polymerizable monomer, an inorganic filler, and an optionally used polymerization initiator and other components are only needed to be added to a dispersion medium and stirred and mixed until being dissolved or dispersed.

The outermost layer can be formed by applying the outermost layer forming coating solution prepared by the above method on the photosensitive layer, and then drying and curing the outermost layer forming coating solution.

In the process of application, drying, and curing, a reaction between the polymerizable monomers proceed, and furthermore when the inorganic filler has a polymerizable group, a reaction between the polymerizable monomer and the inorganic filler, a reaction between the inorganic fillers, and the like proceed, forming the outermost layer containing a cured product of the outermost layer forming composition.

A method for applying the outermost layer forming coating solution is not particularly limited, and a known method such as a dip coating method, a spray coating method, a spinner coating method, a bead coating method, a blade coating method, a beam coating method, a slide hopper coating method, or a circular slide hopper coating method can be used.

After the coating solution is applied, preferably, natural drying or heat drying is performed to form a coating film, and then the coating film is irradiated with an active energy ray to be cured. As the active energy ray, an ultraviolet ray and an electron beam are preferable, and an ultraviolet ray is more preferable.

As a light source of an ultraviolet ray, any light source that generates an ultraviolet ray can be used without limitation. Examples of the light source include a low-pressure mercury lamp, a medium-pressure mercury lamp, a high-pressure mercury lamp, an extra high-pressure mercury lamp, a carbon arc lamp, a metal halide lamp, a xenon lamp, and a flash (pulse) xenon lamp. Irradiation conditions vary depending on a lamp, but an irradiation dose (integrated light amount) of an ultraviolet ray is preferably 5 to 5000 $mJ/cm^2$, and more preferably 10 to 2000 $mJ/cm^2$. Illuminance of an ultraviolet ray is preferably 5 to 500 $mW/cm^2$, and more preferably 10 to 100 $mW/cm^2$.

Irradiation time for obtaining a required irradiation dose (integrated light amount) of an active energy ray is preferably 0.1 seconds to 10 minutes, and more preferably 0.1 seconds to 5 minutes from a viewpoint of operation efficiency.

In a process of forming the outermost layer, drying can be performed before and after irradiation with an active energy ray or during irradiation with an active energy ray, and the timing of drying can be appropriately selected by combining these.

Drying conditions can be appropriately selected depending on the type of solvent, a film thickness, and the like. Drying temperature is not particularly limited, but is preferably 20 to 180° C., and more preferably 80 to 140° C. Drying time is not particularly limited, but is preferably 1 to 200 minutes, and more preferably 5 to 100 minutes.

In the outermost layer, the polymerizable monomer constitutes a polymer (polymerized and cured product). Here, when the inorganic filler has a polymerizable group, in the outermost layer, the polymerizable monomer and the inorganic filler having a polymerizable group constitute an integral polymer (polymerized and cured product) forming the outermost layer. It can be confirmed by analysis of the above polymer (polymerized and cured product) using a known instrumental analysis technique such as pyrolysis GC-MS, nuclear magnetic resonance (NMR), Fourier transform infrared spectrophotometer (FT-IR), or elemental analysis that the polymerized and cured product is a polymer (polymerized and cured product) of a polymerizable monomer or a polymer (polymerized and cured product) of a polymerizable monomer and an inorganic filler having a polymerizable group.

<Toner>

In the electrophotographic image forming apparatus and the electrophotographic image forming method according to an embodiment of the present invention, the toner includes toner base particles and metal oxide particles as an external additive externally added to the toner base particles. That is, the toner particles include toner base particles and external additive metal oxide particles.

Here, "toner base particles" constitute a base of "toner particles". "Toner base particles" contain at least a binder resin, and may further contain another component such as a colorant, a release agent (wax), or a charge control agent, if necessary. "Toner base particles" are referred to as "toner particles" by addition of an external additive. "Toner" means an aggregate of "toner particles".

(Toner Base Particles)

The composition and structure of the toner base particles are not particularly limited, and known toner base particles can be appropriately adopted. Examples of the toner base particles include toner base particles described in JP 2018-72694 A and JP 2018-84645 A.

The binder resin is not particularly limited, and examples thereof include an amorphous resin and a crystalline resin. Here, the amorphous resin refers to a resin not having a melting point and having a relatively high glass transition temperature (Tg) when the resin is subjected to differential scanning calorimetry (DSC). The amorphous resin is not particularly limited, and a known amorphous resin can be used. Examples of the amorphous resin include a vinyl resin, an amorphous polyester resin, a urethane resin, and a urea resin. Among these resins, a vinyl resin is preferable because of easy control of thermoplasticity. The vinyl resin is not particularly limited as long as being obtained by polymerizing a vinyl compound, and examples thereof include a (meth)acrylate resin, a styrene-(meth)acrylate resin, and an ethylene-vinyl acetate resin. Here, the crystalline resin refers to a resin having a clear endothermic peak instead of a stepwise endothermic change in differential scanning calorimetry (DSC). Specifically, the clear endothermic peak refers to a peak having an endothermic peak half-width of 15° C. or less when measurement is performed at a temperature rising rate of 10° C./min in differential scanning calorimetry (DSC). The crystalline resin is not particularly limited, and a known crystalline resin can be used. Examples of the crystalline resin include a crystalline polyester resin, a crystalline polyurethane resin, a crystalline polyurea resin, a crystalline polyamide resin, and a crystalline polyether resin. Among these resins, a crystalline polyester resin is preferably used. Here, the "crystalline polyester resin" is a resin satisfying the endothermic characteristics among known polyester resins obtained by a polycondensation reaction between a divalent or higher carboxylic acid (polyvalent carboxylic acid) and a derivative thereof and a dihydric or higher alcohol (polyhydric alcohol) and a derivative thereof. These resins can be used singly or in combination of two or more types thereof.

The colorant is not particularly limited, and a known colorant can be used. Examples of the colorant include carbon black, a magnetic material, a dye, and a pigment.

The release agent is not particularly limited, and a known release agent can be used. Examples of the release agent include a polyolefin wax, a branched hydrocarbon wax, a long chain hydrocarbon-based wax, a dialkyl ketone-based wax, an ester-based wax, and an amide-based wax.

The charge control agent is not particularly limited, and a known charge control agent can be used. Examples of the charge control agent include a nigrosine-based dye, a metal salt of naphthenic acid or a higher fatty acid, an alkoxylated amine, a quaternary ammonium salt compound, an azo-based metal complex, and a salicylic acid metal salt or a metal complex thereof.

The toner base particles may be toner particles each having a multilayer structure such as a core-shell structure including a core particle and a shell layer covering a surface of the core particle. The shell layer does not have to cover the entire surface of the core particle, and the core particle may be partially exposed. The cross section of the core-shell structure can be confirmed by a known observation means such as a transmission electron microscope (TEM) or a scanning probe microscope (SPM).

The number-based median diameter (D50) of the toner base particles is more than 0 nm and is not particularly limited, but is preferably 3,000 nm or more and 10,000 nm or less, and more preferably 4,000 nm or more and 7,000 nm or less. Within this range, it is easier to control the toner approximate true sphere radius $R_3$ described later so as to be within a preferable range. In addition, the maximum value $R_2'$ of an average distance between projections of a projection structure due to a ridge of the inorganic filler in the outermost layer calculated from a relationship with the average projection height $R_1$ of the outermost layer and the toner approximate true sphere radius $R_3$ can be set within a preferable range for the average distance $R_2$ between projections of a projection structure due to a ridge of the inorganic filler in the outermost layer from a viewpoint of production efficiency.

The number-based median diameter (D50) of toner base particles can be measured with a precise particle size distribution measuring device (Multisizer 3: manufactured by Beckman Coulter, Inc.). Here, for toner particles containing an external additive, the number-based median diameter (D50) of toner base particles can be measured by performing measurement after removal of the external additive.

As a measurement procedure, for example, in a case of toner particles containing an external additive, 0.02 g of toner particles are familiarized with 20 mL of a surfactant solution (for the purpose of dispersing the toner particles, for example, a surfactant solution obtained by diluting a neutral detergent containing a surfactant component 10 times with pure water). Thereafter, the resulting solution is subjected to ultrasonic dispersion for one minute to prepare a dispersion of toner base particles. This dispersion of toner base particles is injected into a beaker containing "ISOTON II" (manufactured by Beckman Coulter, Inc.) in a sample stand with a pipette until a measurement concentration reaches 5 to 10% by mass. Here, by setting the concentration within this concentration range, a reproducible measured value can be obtained. The measurement particle count number is set to 25000. The aperture diameter of a precise particle size distribution measuring device (Multisizer 3: manufactured by Beckman Coulter Co., Ltd.) is set to 100 μm. The frequency number is calculated by dividing a measurement range of 1 to 30 μm into 256 parts. The particle diameter of 50% from a side where the number integration fraction is larger is taken as the number-based median diameter (D50).

Note that the number-based median diameter (D50) of toner base particles can be controlled by the types and addition amounts of raw material particles, reaction temperature, reaction time, and the like in a particle growth reaction in manufacture of the toner base particles.

(External Additive)

In an embodiment of the present invention, the external additive contains metal oxide particles (external additive metal oxide particles). The external additive metal oxide particles have a function of reducing electrostatic and physical adhesion between a transfer member and a toner and improving transferability. Furthermore, the external additive metal oxide particles have a function of improving removability of a residual toner to improve cleaning performance and reducing abrasion of a photoreceptor and a cleaning blade.

Particularly, in a case of an uneven sheet having surface unevenness (such as an embossed sheet), a toner is less likely to be transferred onto a recess than onto a projection. Therefore, in order to improve transferability onto a recess, an external additive contained in the toner reduces electrostatic and physical adhesion between a transfer member of a transfer device and the toner. Here, according to the above-described technique of JP 2015-84078 A, when an external additive is easily released from a toner at the time of cleaning, the amount of the external additive contained in the toner after transfer is insufficient, and transferability onto an uneven sheet is insufficient. However, in the electrophotographic image forming apparatus and the electrophotographic image forming method according to an embodiment of the present invention, release of the external additive can be suppressed. Therefore, good transferability onto an uneven sheet is achieved. Therefore, the electrophotographic image forming apparatus and the electrophotographic image forming method according to an embodiment of the present invention are preferably used for the purpose of forming an image on an uneven sheet.

The metal oxide constituting the external additive metal oxide particles is not particularly limited, and examples thereof include silica (silicon oxide), magnesium oxide, zinc oxide, lead oxide, alumina (aluminum oxide), tantalum oxide, indium oxide, bismuth oxide, yttrium oxide, cobalt oxide, copper oxide, manganese oxide, selenium oxide, iron oxide, zirconium oxide, germanium oxide, tin oxide, titanium dioxide, niobium oxide, molybdenum oxide, vanadium oxide, copper aluminum oxide, and antimony-doped tin oxide. Among these compounds, silica ($SiO_2$) particles, alumina ($Al_2O_3$) particles, and titanium dioxide ($TiO_2$) particles are preferable, and silica particles are more preferable. These metal oxide particles can be used singly or in combination of two or more types thereof.

Here, among the external additive metal oxide particles, external additive metal oxide particles having the largest number average primary particle diameter are referred to as "large-diameter particles". Note that when only one type of external additive metal oxide particles is used, the metal oxide particles are large-diameter particles, and when two or more types of metal oxide particles having the same number average primary particle diameter are used, all the metal oxide particles are large-diameter particles. Usually, as the number average primary particle diameter of the large-diameter particles increases, a value of an external additive average projection height described later increases, and a value of the toner approximate true sphere radius $R_3$ also increases.

The number average primary particle diameter of the large-diameter particles is not particularly limited, but is preferably 10 nm or more, more preferably 50 nm or more, and still more preferably 70 nm or more. The number average primary particle diameter of the large-diameter particles is not particularly limited, but is preferably 300 nm or less, more preferably 200 nm or less, and still more preferably 150 nm or less. Within such a range, it is easier to control the toner approximate true sphere radius $R_3$ described later so as to be within a preferable range. In addition, the maximum value $R_2'$ of an average distance between projections of a projection structure due to a ridge of the inorganic filler in the outermost layer calculated from a relationship with the average projection height $R_1$ of the outermost layer and the toner approximate true sphere radius $R_3$ can be set within a preferable range for the average distance $R_2$ between projections of a projection structure due to a ridge of the inorganic filler in the outermost layer from a viewpoint of production efficiency. Therefore, as a preferable embodiment of the present invention, for example, at least one type of the external additive metal oxide particles has a number average primary particle diameter of 70 nm or more and 150 nm or less.

Here, the number average primary particle diameter of the large-diameter particles can be calculated as follows. A photographic image of a toner taken using a scanning electron microscope (SEM) ("JSM-7401F" manufactured by JEOL Ltd.) is captured by a scanner. Large-diameter particles of the photographic image are binarized using an image processing analyzer ("LUZEX AP" manufactured by Nireco Co., Ltd). Horizontal Feret diameters of 50 large-diameter particles are calculated with respect to one toner particle, and the top 10 values are adopted. The horizontal Feret diameters are calculated with respect to 10 toner particles in total, and an average value of 100 horizontal Feret diameters of the adopted large-diameter particles is taken as the number average primary particle diameter.

Note that in the above measurement, the individual metal oxide particles appearing in the photographic image are assumed to belong to the same metal oxide particle if the composition and crystal structure are the same, and assumed to belong to different metal oxide particles if at least one of the composition and crystal structure is different.

The number average primary particle diameter of external additive metal oxide particles other than large-diameter particles has a small influence on an external additive average projection height described later and the toner approximate true sphere radius $R_3$, and a value of the number average primary particle diameter is not particularly limited. The number average primary particle diameter of external additive metal oxide particles other than large-diameter particles can be calculated by a similar method to that described above except that the particles of interest are changed.

A ratio of the mass of the large-diameter particles with respect to the total mass of the external additive metal oxide particles is more than 0% by mass, and is not particularly limited, but is preferably 50% by mass or more, more preferably 60% by mass or more, and still more preferably 70% by mass or more. A ratio of the mass of the large-diameter particles with respect to the total mass of the external additive metal oxide particles is not particularly limited, but is preferably 100% by mass or less, more preferably 99% by mass or less, still more preferably 90% by mass or less, and particularly preferably 80% by mass or less. Within such a range, it is easier to control the toner approximate true sphere radius $R_3$ described later so as to be within a preferable range while achieving a desired function as a toner.

As the external additive, inorganic particles other than metal oxide particles, organic particles, and a fine powder lubricant may be further contained.

(Characteristics of Toner)

When the toner approximate true sphere radius is defined as in the following formula, the toner approximate true sphere radius is 0 nm or more and is not particularly limited, but is preferably 2000 nm or more and 5000 nm or less, and more preferably 2500 nm or more and 3500 nm or less. Within this range, the maximum value $R_2'$ of an average distance between projections of a projection structure due to a ridge of the inorganic filler in the outermost layer calculated from a relationship with the average projection height $R_1$ of the outermost layer and the toner approximate true sphere radius $R_3$ can be set within a preferable range for the average distance $R_2$ between projections of a projection structure due to a ridge of the inorganic filler in the outermost layer from a viewpoint of production efficiency.

$$\text{Toner approximate true sphere radius } R_3\,[\text{nm}] = (\text{Diameter of toner base particle [nm]} + \text{external additive average projection height [nm]}) \times 2/3 \quad \text{[Numerical formula 5]}$$

The toner approximate true sphere radius can be calculated as follows. Regarding a toner, an average projection height from surfaces of toner base particles (external additive average projection height (nm)) is calculated by three-dimensionally measuring a toner using a three-dimensional roughness analysis scanning electron microscope "ERA-600FE" (manufactured by Elionix Co., Ltd.) and analyzing a roughness in three-dimensional analysis. Subsequently, using the value (nm) of the external additive average projection height and the value (nm) of the number-based median diameter (D50) of toner base particles described above as a diameter, the toner approximate true sphere radius is calculate using the above formula.

Here, it has been confirmed that the external additive average projection height mainly relates to a value of the average particle diameter of the large-diameter particles. Therefore, it is presumed that the projection formed by the large-diameter particles has a large influence on the external additive average projection height.

The external additive average projection height is 0 nm or more, and is not particularly limited, but is preferably 5 nm or more and 60 nm or less, more preferably 10 nm or more and 50 nm or less, and still more preferably 20 nm or more and 40 nm or less. Within this range, the maximum value $R_2'$ of an average distance between projections of a projection structure due to a ridge of the inorganic filler in the outermost layer calculated from a relationship with the average projection height $R_1$ of the outermost layer and the toner approximate true sphere radius $R_3$ can be set within a preferable range for the average distance $R_2$ between projections of a projection structure due to a ridge of the inorganic filler in the outermost layer from a viewpoint of production efficiency.

In the electrophotographic image forming apparatus and the electrophotographic image forming method according to an embodiment of the present invention, 70% or more of the toner base particles are covered with the metal oxide particles as an external additive. That is, in the electrophotographic image forming apparatus and the electrophotographic image forming method, the coverage of the toner base particles with the external additive metal oxide particles (hereinafter, also simply referred to as "coverage") is 70% or more.

Here, "coverage of toner base particles with metal oxide particles as an external additive" refers to occupancy (%) of the area of the external additive metal oxide particles occupying toner particles with respect to the area of one toner particle in a photographic image of a scanning electron microscope (SEM).

When the coverage is less than 70%, particularly, cleaning performance is insufficient, and furthermore, transferability onto an uneven sheet also decreases. A reason for this is presumed as follows. By contact between the toner base particles and the outermost layer, adhesion and friction between the toner and the outermost layer increases. In addition, a rushing force when a residual toner rushes into a cleaning blade increases, and ease of removal of the residual toner from the outermost layer at the time of cleaning decreases. Therefore, the coverage is more preferably 75% or more (upper limit: 100%) particularly from a viewpoint of improving cleaning performance, and furthermore a viewpoint of transferability onto an uneven sheet.

The coverage of the toner base particles can be calculated as follows. Regarding a toner, a photographic image of a toner taken using a scanning electron microscope (SEM) ("JSM-7401F" manufactured by JEOL Ltd.) is captured by a scanner. External additive metal oxide particles of the photographic image are binarized using an image processing analyzer ("LUZEX AP" manufactured by Nireco Co., Ltd.), and occupancy (%) of the area of the external additive metal oxide particles occupying toner particles with respect to the area per toner particle is calculated. The occupancy is calculated for 10 toner particles in total, and an average value of the obtained occupancies is taken as the coverage (%) of the toner base particles.

The coverage can be controlled by the content ratio of the external additive metal oxide particles to the toner base particles, a combination of the type of toner base particles (particularly, a binder resin) with the type of external additive metal oxide particles, and the like.

(Method for Manufacturing Toner)

A method for manufacturing the toner base particles is not particularly limited, and examples thereof include a known method such as a kneading pulverization method, a suspension polymerization method, an emulsion aggregation method, a dissolution suspension method, a polyester elongation method, or a dispersion polymerization method. Among these methods, the emulsion aggregation method is preferable from a viewpoint of uniformity of particle diameters and controllability of the shape. The emulsion aggregation method is a method for manufacturing toner base particles by mixing a dispersion of particles of a binder resin dispersed by a surfactant or a dispersion stabilizer with a dispersion of particles of a colorant, if necessary, aggregating the particles until a desired toner particle diameter is reached, further fusing the binder resin particles, and thereby controlling the shapes. Here, the particles of the binder resin may optionally contain a release agent, a charge control agent, and the like.

For an external addition of an external additive to the toner base particles, a mechanical mixing device can be used. Examples of the mechanical mixing device include a Henschel mixer, a Nauta mixer, and a turbuler mixer. Among these devices, using a mixing device capable of applying a shearing force to particles to be treated, like a Henschel mixer, it is only required to perform mixing treatment such as elongating mixing time or increasing a rotational peripheral speed of a stirring blade. In a case of using a plurality of types of external additives, all the external additives may be mixed at once with the toner particles, or the external additives may be mixed with the toner particles a plurality of times by dividing the external additives into a plurality of portions according to the external additives.

(Developing Agent)

The toner can be used as a magnetic or non-magnetic one-component developing agent, but may be used as a two-component developing agent by being mixed with a carrier.

In a case where the toner is used as a two-component developing agent, as a carrier, it is possible to use magnetic particles formed of a conventionally known material, for example, a ferromagnetic metal such as iron, an alloy made of a ferromagnetic metal and aluminum, lead, or the like, or a ferromagnetic metal compound such as ferrite or magnetite. Ferrite is particularly preferable.

Embodiments of the present invention have been described above, but the present invention is not limited to the above embodiments, and various modifications can be made thereto.

EXAMPLES

An effect of the present invention will be described using the following Examples and Comparative Examples. However, the technical scope of the present invention is not limited only to the following Examples. Note that, in the following Examples, operations were performed at room temperature (25° C.) unless otherwise specified. Note that "%" and "parts" mean "% by mass" and "parts by mass", respectively, unless otherwise specified.

<Preparation of Composite Particles (Core-Shell Particles)>

Figure 5:
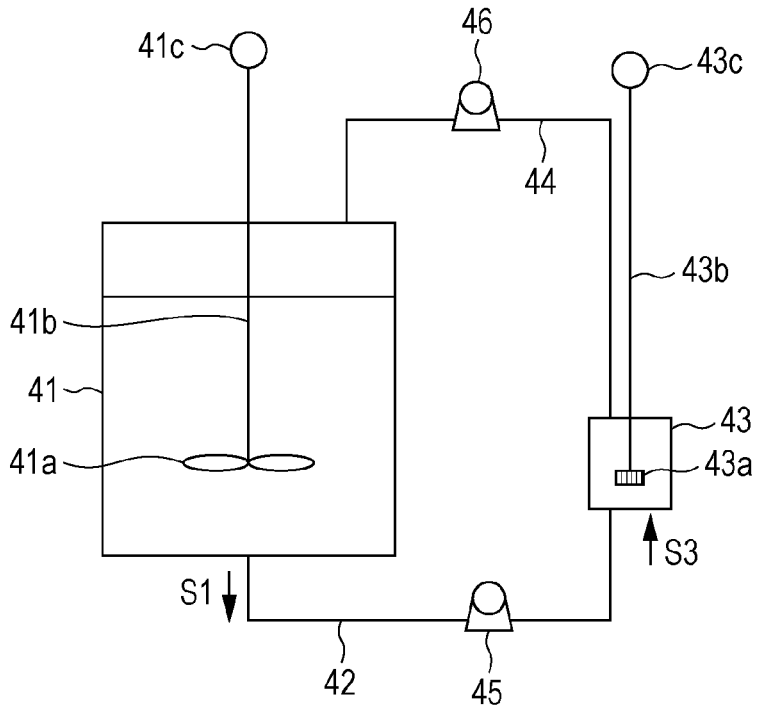
FIG. 5 is a schematic configuration view exemplifying a manufacturing device used for preparing composite particles (core-shell particles).

Using a manufacturing device illustrated in FIG. 5, composite particles in each of which a covering layer (shell) of tin oxide ($SnO_2$) was formed on a surface of a barium sulfate ($BaSO_4$) core material (core) were prepared. Note that the composite particles are written as "$SnO_2/BaSO_4$" in Table 1 below.

Specifically, 3500 $cm^3$ of pure water was put in a mother liquid tank 41, then 900 g of a spherical barium sulfate core material having a number average primary particle diameter of 95 nm was put therein, and circulation of 5 passes was performed. A flow rate of a slurry flowing out of the mother liquid tank 41 was 2280 $cm^3$/min. A stirring speed of a strong dispersion device 43 was 16000 rpm. After the circulation was completed, the slurry was made up to a total volume of 9000 $cm^3$ with pure water, 1,600 g of sodium stannate and 2.3 $cm^3$ of a sodium hydroxide aqueous solution (concentration: 25 N) were put therein, and circulation of 5 passes was performed. In this way, a mother liquid was obtained.

While this mother liquid was circulated such that a flow rate S1 flowing out of the mother liquid tank 41 was 200 $cm^3$, 20% sulfuric acid was fed to a homogenizer "magic LAB (registered trademark)" manufactured by IKA Japan K.K.) as the strong dispersion device 43. A feeding rate S3 was 9.2 $cm^3$/min. The homogenizer had a volume of 20 $cm^3$ and a stirring speed of 16000 rpm. Circulation was performed for 15 minutes, during which sulfuric acid was continuously fed to the homogenizer to obtain a slurry containing particles.

The resulting slurry was repulp-washed until conductivity thereof reached 600 μS/cm or less, and then Nutsche filtration was performed to obtain a cake. The cake was dried in air at 150° C. for 10 hours. Subsequently, the dried cake was pulverized, and the pulverized powder was subjected to reduction firing for 45 minutes at 450° C. in a 1% by volume $H_2/N_2$ atmosphere. In this way, composite particles having a number average primary particle diameter of 100 nm, in each of which an outer shell (shell) of tin oxide was formed on a surface of a core material (core) of barium sulfate, were prepared.

Here, in the manufacturing device illustrated in FIG. 5, reference numerals 42 and 44 denote circulation pipes forming a circulation path between the mother liquid tank 41 and the strong dispersion device 43, reference numerals 45 and 46 denote pumps disposed in the circulation pipes 42 and 44, respectively, reference numeral 41*a* denotes a stirring blade, a reference numeral 43*a* denotes a stirrer, reference numerals 41*b* and 43*b* denote shafts, and reference numerals 41*c* and 43*c* denote motors.

<Preparation of Metal Oxide Particles (Surface-Treated Particles) Subjected to Surface Treatment with Surface Treatment Agent>

(Preparation of Surface-Treated Particles 1)

[Surface Treatment with Reactive Surface Treatment Agent (Reactive Surface Treatment)]

To 10 mL of methanol, 5 g of tin oxide as untreated metal oxide particles (untreated mother particles) (number average primary particle diameter: 20 nm) was added, and was dispersed at room temperature for 30 minutes using a US homogenizer. Subsequently, 0.25 g of 3-methacryloxypropyl trimethoxysilane ("KBM-503" manufactured by Shin-Etsu Chemical Co., Ltd.) as a reactive surface treatment agent and 10 mL of toluene were added, and the resulting mixture was stirred at room temperature for 60 minutes. The solvent was removed with an evaporator. Thereafter, the residue was heated at 120° C. for 60 minutes to obtain surface-treated particles 1 as metal oxide particles surface-treated with the reactive surface treatment agent. The surface-treated particles 1 have a polymerizable group.

(Preparation of Surface-Treated Particles 2)

[Surface Treatment with Reactive Surface Treatment Agent (Reactive Surface Treatment)]

To 10 mL of methanol, 5 g of tin oxide as untreated metal oxide particles (untreated mother particles) (number average primary particle diameter: 20 nm) was added, and was dispersed at room temperature for 30 minutes using a US homogenizer. Subsequently, 0.25 g of 3-methacryloxypropyl trimethoxysilane ("KBM-503" manufactured by Shin-Etsu Chemical Co., Ltd.) as a reactive surface treatment agent and 10 mL of toluene were added, and the resulting mixture was stirred at room temperature for 60 minutes. The solvent was removed with an evaporator. Thereafter, the residue was heated at 120° C. for 60 minutes to obtain metal oxide particles surface-treated with the reactive surface treatment agent.

[Surface Treatment with Silicone Surface Treatment Agent (Silicone Surface Treatment)]

Subsequently, 5 g of the metal oxide particles surface-treated with the reactive surface treatment agent obtained above was added to 40 g of 2-butanol and dispersed at room temperature for 60 minutes using a US homogenizer. Subsequently, 0.15 g of a linear silicone surface treatment agent ("KF-9901" manufactured by Shin-Etsu Chemical Co., Ltd.) was added, and was further dispersed at room temperature for 60 minutes using a US homogenizer. After the dispersion, the solvent was volatilized at room temperature, and the residue was dried at 120° C. for 60 minutes to prepare surface-treated particles 2 as metal oxide particles surface-treated with the reactive surface treatment agent and the silicone surface treatment agent. The surface-treated particles 2 have a polymerizable group.

(Preparation of Surface-Treated Particles 3 to 7, 9 to 11, and 13)

Surface-treated particles 3 to 7, 9 to 11, and 13 were prepared in a similar manner to manufacture of surface-treated particles 2 except that the type of untreated metal oxide particles as untreated base particles, the type of reactive surface treatment agent used for surface treatment with a reactive surface treatment agent, and the type of silicone surface treatment agent used for surface treatment with a silicone surface treatment agent were changed as illustrated in Table 1 below. These surface-treated particles have a polymerizable group.

(Preparation of Surface-Treated Particles 8)

[Surface Treatment with Silicone Surface Treatment Agent (Silicone Surface Treatment)]

To 10 mL of 2-butanol, 5 g of tin oxide as untreated metal oxide particles (untreated mother particles) (number average primary particle diameter: 20 nm) was added, and was dispersed at room temperature for 60 minutes using a US homogenizer. Subsequently, 0.15 g of a surface treatment agent (KF-9908 manufactured by Shin-Etsu Chemical Co., Ltd.) having a silicone chain in a side chain of a silicone main chain was added thereto, and was further dispersed at room temperature for 60 minutes using a US homogenizer. After the dispersion, the solvent was volatilized at room temperature, and the residue was dried at 80° C. for 60 minutes to prepare surface-treated particles 8 as metal oxide particles surface-treated with the silicone surface treatment agent.

The compositions of the surface-treated particles are illustrated in Table 1 below.

(Surface Treatment Agent Used)

Details of the silicone surface treatment agent and the reactive surface treatment agent illustrated in Table 1 below are described below;

- KF-99: linear silicone surface treatment agent (methyl hydrogen silicone oil) manufactured by Shin-Etsu Chemical Co., Ltd.,
- KF-9901: linear silicone surface treatment agent (methyl hydrogen silicone oil) manufactured by Shin-Etsu Chemical Co., Ltd.,
- KF-9908: side chain type silicone surface treatment agent having a silicone chain in a side chain of a silicone main chain, manufactured by Shin-Etsu Chemical Co., Ltd.,
- KF-9909: side chain type silicone surface treatment agent having a silicone chain in a side chain of a silicone main chain, manufactured by Shin-Etsu Chemical Co., Ltd.,
- KF-574: side chain type silicone surface treatment agent having a silicone chain in a side chain of a poly(meth) acrylate main chain, manufactured by Shin-Etsu Chemical Co., Ltd., and
- KBM-503: silane coupling agent having a radically polymerizable group (3-methacryloxypropyl trimethoxysilane), manufactured by Shin-Etsu Chemical Co., Ltd.

[Table 1]

TABLE 1

| Inorganic filler | | | | | | |
|---|---|---|---|---|---|---|
| | Untreated base particles (Untreated metal oxide particles) | | Silicone surface treatment | | Reactive surface treatment | |
| Surface-treated particles No. | Type | Number average primary particle diameter (nm) | Surface-treated or not surface-treated | Surface treatment agent | Surface-treated or not surface-treated | Surface treatment agent |
| 1 | $SnO_2$ | 20 | Not surface-treated | | Surface-treated | KBM-503 |
| 2 | $SnO_2$ | 20 | Surface-treated | KF-9901 | Surface-treated | KBM-503 |
| 3 | $SnO_2$ | 20 | Surface-treated | KF-9908 | Surface-treated | KBM-503 |
| 4 | $SnO_2$ | 60 | Surface-treated | KF-9908 | Surface-treated | KBM-503 |
| 5 | $SnO_2$ | 100 | Surface-treated | KF-9908 | Surface-treated | KBM-503 |
| 6 | $SnO_2$ | 180 | Surface-treated | KF-9908 | Surface-treated | KBM-503 |
| 7 | $SnO_2$ | 220 | Surface-treated | KF-9908 | Surface-treated | KBM-503 |
| 8 | $SnO_2$ | 100 | Surface-treated | KF-9908 | Not surface-treated | |
| 9 | $SnO_2/BaSO_4$ | 100 | Surface-treated | KF-9908 | Surface-treated | KBM-503 |
| 10 | $SnO_2/BaSO_4$ | 100 | Surface-treated | KP-578 | Surface-treated | KBM-503 |
| 11 | $SnO_2/BaSO_4$ | 100 | Surface-treated | KF-9909 | Surface-treated | KBM-503 |
| 13 | $SnO_2$ | 10 | Surface-treated | KF-9908 | Surface-treated | KBM-503 |

<Preparation of Electrophotographic Photoreceptor>

(Preparation of Photoreceptor 1)

(1) Preparation of Conductive Support

A surface of a cylindrical aluminum support was cut to prepare a conductive support.

(2) Formation of Intermediate Layer

The following components were mixed in the following amounts, and dispersion was performed for 10 hours by a batch method using a sand mill as a dispersing machine to form an intermediate layer forming coating solution. Subsequently, the obtained intermediate layer forming coating solution was applied onto the conductive support by a dip coating method and dried at 110° C. for 20 minutes to form an intermediate layer having a dry film thickness of 2 μm.

10 parts by mass of polyamide resin (X1010 manufactured by Daicel-Evonik Ltd.), 11 parts by mass of titanium oxide (SMT-500SAS manufactured by Tayca Co., Ltd.), and 200 parts by mass of ethanol.

(3) Formation of Charge Generating Layer

The following components were mixed in the following amounts, and dispersion was performed at 19.5 kHz at 600 W at a circulation flow rate of 40 L/H for 0.5 hours using a circulation type ultrasonic homogenizer (RUS-600TCVP manufactured by NIHONSEIKI KAISHA LTD.) to prepare a charge generating layer forming coating solution. Subsequently, the obtained charge generating layer forming coating solution was applied onto the intermediate layer by a dip coating method and dried to form a charge generating layer having a dry film thickness of 0.3 μm.

24 parts by mass of charge generating material (mixed crystal of 1:1 adduct of titanyl phthalocyanine and (2R,3R)-2,3-butanediol having clear peaks at 8.3°, 24.7°, 25.1°, and 26.5° in Cu-Kα characteristic X-ray diffraction spectrum measurement and unadded titanyl phthalocyanine), 12 parts by mass of polyvinyl butyral resin (S-LEC (registered trademark) BL-1 manufactured by Sekisui Chemical Co., Ltd.), and 400 parts by mass of a 3-methyl-2-butanone/cyclohexanone mixed solvent (3-methyl-2-butanone:cyclohexanone=4:1 (volume ratio)).

(4) Formation of Charge Transporting Layer

The following components were mixed in the following amounts to prepare a charge transporting layer coating solution. The coating solution was applied to a surface of the charge generating layer by a dip coating method, and dried at 120° C. for 70 minutes to form a charge transporting layer having a film thickness of 24 μm on the charge generating layer.

60 parts by mass of charge transporting material represented by the following structural formula (4), 100 parts by mass of polycarbonate resin (Z300 manufactured by Mitsubishi Gas Chemical Co., Ltd.), 4 parts by mass of antioxidant (IRGANOX (registered trademark) 1010 manufactured by BASF SE), 800 parts by mass of a toluene/tetrahydrofuran mixed solvent (toluene:tetrahydrofuran=1:9 (volume ratio)), and 1 part by mass of silicone oil (KF-54 manufactured by Shin-Etsu Chemical Co., Ltd.).

[Chemical formula 4]

Formula (4)

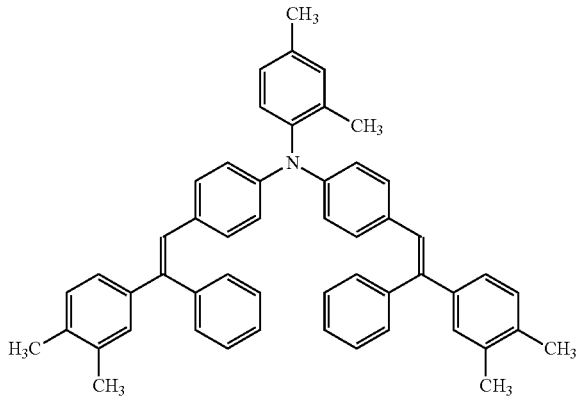

(5) Formation of Protective Layer (Outermost Layer)

The following components were mixed in the following amounts to prepare a protective layer forming coating solution (outermost layer forming coating solution). Subsequently, the obtained protective layer forming coating solution was applied onto the charge transporting layer using a circular slide hopper coater, and then irradiated with an ultraviolet ray at 16 mW/cm$^2$ for one minute (integrated light amount: 960 mJ/cm$^2$) using a metal halide lamp to form a protective layer having a dry film thickness of 3.0 μm, thus preparing photoreceptor 1;

120 parts by mass of radically polymerizable monomer (the compound M2: trimethylolpropane trimethacrylate), 100 parts by mass of surface-treated particles 1, 10 parts by mass of polymerization initiator (IRGACURE (registered trademark) 819 manufactured by BASF Japan Ltd.), and 400 parts by mass of 2-butanol.

(Preparation of Photoreceptors 2 and 3)

Photoreceptors 2 and 3 were prepared in a similar manner to Preparation Example 1 of the photoreceptor except that the type of surface-treated particles used for preparation of the protective layer was changed as illustrated in Table 2 below.

(Preparation of Photoreceptors 4 to 12)

Photoreceptors 4 to 12 were prepared in a similar manner to Preparation Example 1 of the photoreceptor except that the type of surface-treated particles used for preparation of the protective layer was changed as illustrated in Table 2 below, and the addition amount of the surface-treated particles used for preparation of the protective layer was changed from 100 parts by mass to 125 parts by mass.

(Preparation of Photoreceptor 13)

Photoreceptor 13 was prepared in a similar manner to Preparation Example 10 of the photoreceptor except that the addition amount of the surface-treated particles used for preparation of the protective layer was changed from 100 parts by mass to 75 parts by mass.

(Preparation of Photoreceptor 14)

Photoreceptor 14 was prepared according to paragraphs "0108" to "0115" of JP 2015-84078 A. Here, an inorganic filler contained in a protective layer of photoreceptor 14 was formed of untreated $TiO_2$ particles having a number average primary particle diameter of 100 nm, and this inorganic filler was used as untreated particles 12.

(Preparation of Photoreceptor 15)

Photoreceptor 15 was prepared in a similar manner to Preparation Example 1 of the photoreceptor except that the type of surface-treated particles used for preparation of the protective layer was changed as illustrated in Table 2 below, and the addition amount of the surface-treated particles used for preparation of the protective layer was changed from 100 parts by mass to 75 parts by mass.

Note that the protective layer corresponds to the outermost layer in each of the photoreceptors prepared by the above method.

Here, in the protective layers of photoreceptors 1 to 13 and 15, it was confirmed that silicon, which is a chemical species derived from a silicone surface treatment agent, was present on surfaces of the metal oxide particles of surface-treated particles 2 to 11 that had been subjected to silicone surface treatment.

It is presumed that surface-treated particles 1 to 7, 9 to 11, and 13 having polymerizable functional groups react with a radically polymerizable monomer in the protective layer of the photoreceptor to obtain groups derived from the polymerizable groups.

<Evaluation of Electrophotographic Photoreceptor>

(Analysis of Projection Structure of Outermost Layer)

Regarding an obtained photoreceptor, it was confirmed by visually observing a photographic image of a surface of the photoreceptor taken using a scanning electron microscope (SEM) "JSM-7401F" (manufactured by JEOL Ltd.) that the projection structure of the outermost layer was formed by a ridge of metal oxide particles.

(Measurement of Average Projection Height $R_1$ of Outermost Layer)

Regarding an obtained photoreceptor, a surface of the protective layer was three-dimensionally measured using a three-dimensional roughness analysis scanning electron microscope "ERA-600FE" (manufactured by Elionix Co., Ltd.), an average height of outline curve elements was calculated in three-dimensional analysis, and the calculated value was used as the average projection height $R_1$ of the outermost layer. $R_1$ of each photoreceptor is illustrated in Table 2 below as an average projection height.

(Measurement of Average Distance $R_2$ Between Projections of Projection Structure Due to Ridge of Inorganic Filler in Outermost Layer)

Regarding an obtained photoreceptor, a photographic image of a surface of a protective layer taken using a scanning electron microscope (SEM) ("JSM-7401F" manufactured by JEOL Ltd.) was captured by a scanner. Portions of surface-treated particles or untreated particles (metal oxide particles) of the photographic image were binarized using an image processing analyzer ("LUZEX AP" manufactured by Nireco Co., Ltd.), and a two-point distance between surface-treated particles or untreated particles (metal oxide particles) was calculated for 50 points. An average value of these distances was calculated, and this average value was taken as an average distance between projections in the outermost layer. $R_2$ of each photoreceptor is illustrated in Table 2 below as an average distance between projections.

<Preparation of Toner>

(Preparation of Toner 1)

(1) Preparation of Toner Base Particles 1

(1.1) Preparation of Dispersion of Core Part Resin Particles A (1.1.1) First Stage Polymerization Into a reaction vessel equipped with a stirrer, a temperature sensor, a temperature control device, a cooling tube, and a nitrogen introducing device, an anionic surfactant solution obtained by dissolving 2.0 parts by mass of sodium lauryl sulfate as an anionic surfactant in 2900 parts by mass of deionized water in advance was put. While the anionic surfactant solution was stirred at a stirring speed of 230 rpm under a nitrogen stream, the internal temperature was raised to 80° C.

To the anionic surfactant solution, 9.0 parts by mass of potassium persulfate (KPS) as a polymerization initiator was added, and the internal temperature was set to 78° C. To the anionic surfactant solution to which the polymerization initiator had been added, monomer solution 1 in which the following components were mixed in the following amounts was dropwise added over three hours. After completion of the dropwise addition, this system was heated and stirred at 78° C. for one hour to perform polymerization (first stage polymerization), thus preparing a dispersion of resin particles a1.

540 parts by mass of styrene,
154 parts by mass of n-butyl acrylate,
77 parts by mass of methacrylic acid, and
17 parts by mass of n-octyl mercaptan.

(1.1.2) Second Stage Polymerization: Formation of Intermediate Layer

The following components were mixed in the following amounts, and 51 parts by mass of paraffin wax (melting point: 73° C.) was added thereto as an offset inhibitor. The resulting mixture was heated to 85° C. for dissolution to prepare monomer solution 2.

94 parts by mass of styrene,
27 parts by mass of n-butyl acrylate,
6 parts by mass of methacrylic acid, and
1.7 parts by mass of n-octyl mercaptan.

A surfactant solution obtained by dissolving 2 parts by mass of sodium lauryl sulfate as an anionic surfactant in 1100 parts by mass of deionized water was heated to 90° C., and a dispersion of resin particles a1 was added to this surfactant solution in an amount of 28 parts by mass in terms of solid content of resin particles a1. Thereafter, monomer solution 2 was mixed therewith and dispersed for four hours with a mechanical dispersing machine having a circulation path ("CLEARMIX (registered trademark)" manufactured by M Technique Co., Ltd.) to prepare a dispersion containing an emulsified particle having a dispersed particle diameter of 350 nm. To the dispersion, an initiator aqueous solution obtained by dissolving 2.5 parts by mass of KPS as a polymerization initiator in 110 parts by mass of deionized water was added. This system was heated and stirred at 90° C. for two hours to perform polymerization (second stage polymerization), thus preparing a dispersion of resin particles all.

(1.1.3) Third Stage Polymerization: Formation of Outer Layer (Preparation of Core Part Resin Particles A)

To the dispersion of resin particles all, an initiator aqueous solution obtained by dissolving 2.5 parts by mass of KPS as a polymerization initiator in 110 parts by mass of deionized water was added. Monomer solution 3 obtained by blending the following components in the following amounts was dropwise added thereto over one hour at a temperature of 80° C. After completion of the dropwise addition, this system was heated and stirred for three hours to perform polymerization (third stage polymerization). Thereafter, the system was cooled to 28° C. to prepare a dispersion of core part resin particles A in which core part resin particles A were dispersed in an anionic surfactant solution. The core part resin particles A had a glass transition point of 45° C. and a softening point of 100° C.

230 parts by mass of styrene,
78 parts by mass of n-butyl acrylate,
16 parts by mass of methacrylic acid, and
4.2 parts by mass of n-octyl mercaptan.

(1.2) Preparation of Dispersion of Shell Layer Resin Particles B (1.2.1) Synthesis of Shell Layer Resin (Styrene-Acrylic Modified Polyester Resin B)

To a 10-liter four-necked flask equipped with a nitrogen introduction tube, a dehydration tube, a stirrer, and a thermocouple, the following component 1 was put in the following amount, and a polycondensation reaction was caused at 230° C. for eight hours. A reaction was further caused for one hour at 8 kPa, and the system was cooled to 160° C.

(Components 1)

500 parts by mass of 2 mol adduct of bisphenol A propylene oxide,
117 parts by mass of terephthalic acid,
82 parts by mass of fumaric acid, and
2 parts by mass of esterification catalyst (tin octylate).

Subsequently, a mixture obtained by mixing the following components 2 in the following amounts was dropwise added to the above cooled solution through a dropping funnel over one hour. After the dropwise addition, an addition polymerization reaction was continued for one hour while the temperature was maintained at 160° C. Thereafter, the temperature was raised to 200° C., and the system was held at 10 kPa for one hour. Thereafter, unreacted acrylic acid, styrene, and butyl acrylate were removed to obtain styrene-acrylic modified polyester resin B. The obtained styrene-acrylic modified polyester resin B had a glass transition point of 60° C. and a softening point of 105° C.

(Components 2)

10 parts by mass of acrylic acid,
30 parts by mass of styrene,
7 parts by mass of butyl acrylate, and
10 parts by mass of polymerization initiator (di-t-butyl peroxide).

(1.2.2) Preparation of Dispersion of Shell Layer Resin Particles B 100 parts by mass of the obtained styrene-acrylic modified polyester resin B was pulverized with a pulverizer (RM type Roundel Mill manufactured by Tokuju Corporation) and mixed with 638 parts by mass of a 0.26% by mass sodium lauryl sulfate solution prepared in advance. The resulting mixture was ultrasonically dispersed at V-LEVEL at 300 μA for 30 minutes using an ultrasonic homogenizer ("US-150T" manufactured by Nippon Seiki Seisakusho Co., Ltd.) while being stirred to prepare a dispersion of shell layer resin particles B in which shell layer resin particles B having a number-based median diameter (D50) of 250 nm were dispersed.

(1.3) Preparation of Colorant Particle Dispersion 1

90 parts by mass of sodium dodecyl sulfate was stirred and dissolved in 1600 parts by mass of deionized water. While this solution was stirred, 420 parts by mass of carbon black ("MOGUL L" manufactured by Cabot Corporation) was gradually added thereto. Subsequently, the resulting mixture was dispersed using a stirrer ("CLEARM IX (registered trademark)" manufactured by M Technique Co., Ltd.) to prepare colorant particle dispersion 1 in which colorant particles were dispersed. The particle diameter of each of the colorant particles in this dispersion was measured using a Microtrac particle size distribution measuring device ("UPA-150" manufactured by Nikkiso Co., Ltd.) and found to be 117 nm.

(1.4) Preparation of Toner Base Particles 1 (Aggregation, Fusion-Washing-Drying)

Into a reaction vessel equipped with a stirrer, a temperature sensor, and a cooling tube, 288 parts by mass of the dispersion of core part resin particles A in terms of solid content and 2000 parts by mass of deionized water were put, and a 5 mol/L sodium hydroxide aqueous solution was added thereto to adjust the pH to 10 (25° C.).

Thereafter, 40 parts by mass of the colorant particle dispersion 1 in terms of solid content was put thereinto. Subsequently, an aqueous solution obtained by dissolving 60 parts by mass of magnesium chloride in 60 parts by mass of deionized water was added thereto under stirring at 30° C. over 10 minutes. Thereafter, the resulting mixture was allowed to stand for three minutes, and then the temperature was started to be raised. This system was heated to 80° C. over 60 minutes. While the temperature was maintained at 80° C., a particle growth reaction was continued. In this state, the particle diameter of a core particle was measured with a precise particle size distribution measuring device ("Multisizer 3" manufactured by Beckman Coulter Co., Ltd.). When the number-based median diameter (D50) reached 5.8 μm, 72 parts by mass of the dispersion of shell layer resin particles B in terms of solid content was put thereinto over 30 minutes. When the supernatant of the reaction liquid became transparent, an aqueous solution obtained by dissolving 190 parts by mass of sodium chloride in 760 parts by mass of deionized water was added thereto to stop particle growth. The temperature was further raised, and the system was heated and stirred at 90° C. to promote fusion-bonding of the particles. Measurement was performed (at the HPF detection number of 4000) using a toner average circularity measuring device ("FPIA-2100" manufactured by Sysmex Corporation). When the average circularity reached 0.945, the temperature was lowered to 30° C. to obtain a dispersion of toner base particles 1.

The dispersion of toner base particles 1 was subjected to solid-liquid separation using a centrifuge to form a wet cake of toner base particles 1. The wet cake was washed with deionized water at 35° C. until the electric conductivity of a filtrate reached 5 μS/cm, then transferred to an air flow type dryer ("flash jet dryer" manufactured by Seishin Enterprise Co., Ltd.), and dried until the water content reached 0.5% by mass to obtain toner base particles 1.

The particle diameter of each of toner base particles 1 was measured with a precise particle size distribution measuring device ("Multisizer 3" manufactured by Beckman Coulter Co., Ltd.), and the number-based median diameter (D50) thereof was found to be 6.0 μm.

(2) Preparation of Toner 1

To 100 parts by mass of toner base particles 1, 1.0 part by mass of $SiO_2$ particles that are large-diameter particles (number average primary particle diameter: 80 nm) as an external additive and 0.3 parts by mass of hydrophobic titania particles (number average primary particle diameter: 20 nm) were added and mixed with a Henschel mixer to prepare toner 1.

(Preparation of Toners 2 to 4)

Toners 2 to 4 were prepared in a similar manner to preparation of toner 1 except that the number average primary particle diameter of $SiO_2$ particles that are large-diameter particles was changed as illustrated in Table 2 below.

(Preparation of Toners 5 and 6)

Toners 5 and 6 were prepared in a similar manner to preparation of toner 1 except that $TiO_2$ particles and $Al_2O_3$ particles illustrated in Table 2 below were used as large-diameter particles in place of $SiO_2$ particles, respectively.

(Preparation of Toner 7)

To 100 parts by mass of toner base particles 1, 0.9 parts by mass of $SiO_2$ particles that are large-diameter particles (number average primary particle diameter: 80 nm) as an external additive and 0.3 parts by mass of hydrophobic titania particles (number average primary particle diameter: 20 nm) were added and mixed with a Henschel mixer to prepare toner 7.

(Preparation of Toner 8)

Toner base particles 2 having a number-based median diameter (D50) of 3.5 μm were prepared in a similar manner to preparation of toner 1 except that the duration of the particle growth reaction was changed in preparation of toner base particles 1.

Subsequently, to 100 parts by mass of toner base particles 2, as an external additive, 1.0 part by mass of $SiO_2$ particles that are large-diameter particles (number average primary particle diameter: 80 nm) and 0.3 parts by mass of hydrophobic titania particles (number average primary particle diameter: 20 nm) were added and mixed with a Henschel mixer to prepare toner 8.

<Evaluation of Toner>

(Calculation of Toner Approximate True Sphere Radius $R_3$)

Regarding an obtained toner, an average projection height from surfaces of toner base particles (external additive average projection height (nm)) was calculated by three-dimensionally measuring a toner using a three-dimensional roughness analysis scanning electron microscope "ERA-6001FE" (manufactured by Elionix Co., Ltd.) and analyzing a roughness in three-dimensional analysis. Subsequently, a toner approximate true sphere radius was calculated by the following formula. Here, as the diameter of each of toner base particles 1, 6.0 μm (6,000 nm) as the number-based median diameter (D50) measured in the preparation of the toner was adopted. As the diameter of each of toner base particles 2, 3.5 μm (3,500 nm) as the number-based median diameter (D50) measured in the preparation of the toner was adopted. The external additive average projection height and the toner approximate true sphere radius $R_3$ of each toner are illustrated in Table 2 below.

Toner approximate true sphere radius $R_3$ [nm]=(Diameter of toner base particle [nm]+external additive average projection height [nm])/2 [Numerical formula 6]

(Calculation of Coverage of Toner Base Particles)

Regarding an obtained toner, a photographic image of a toner taken using a scanning electron microscope (SEM) ("JSM-7401F" manufactured by JEOL Ltd.) was captured by a scanner. External additive metal oxide particles of the photographic image are binarized using an image processing analyzer ("LUZEX AP" manufactured by Nireco Co., Ltd.), and occupancy (%) of the area of the external additive metal oxide particles occupying toner particles with respect to the area per toner particle was calculated. The occupancy was calculated for 10 toner particles in total, and an average value of the obtained occupancies was taken as the coverage (%) of the toner base particles. The coverage of toner base particles of each toner is illustrated in Table 2 below.

<Evaluation of Electrophotographic Image Forming Apparatus and Electrophotographic Image Forming Method Using Non-Contact Type Charging Device as Charger>

(Preparation of Electrophotographic Image Forming Apparatus)

Any one of electrophotographic photoreceptors 1 to 15 prepared above and any one of toners 1 to 8 prepared above were combined to each other as described in Table 2 below, and the combination was mounted on a full color printer ("bizhub PRESS (registered trademark) C1070" manufactured by Konica Minolta Inc.) to prepare each of electrophotographic image forming apparatuses 1 to 20.

Here, the full color printer has a corona discharge type charging device (scorotron) that is a non-contact type charging device as a charger.

These electrophotographic image forming apparatuses each include: an electrophotographic photoreceptor; a charger that charges a surface of the electrophotographic photoreceptor; an exposer that exposes the charged electrophotographic photoreceptor to form an electrostatic latent image; a developer that supplies a toner to the electrophotographic photoreceptor on which the electrostatic latent image is formed to form a toner image; a lubricant supplier that supplies a lubricant to a surface of the electrophotographic photoreceptor; a transferer that transfers a toner image formed on the electrophotographic photoreceptor; and a cleaner that removes a residual toner remaining on a surface of the electrophotographic photoreceptor.

Regarding electrophotographic image forming apparatuses 1 to 21, it was confirmed whether $R_2$ satisfied relationships of the following formulas (1) to (3) using the average projection height $R_1$ (nm) of the outermost layer and the average distance $R_2$ (nm) between projections of a projection structure due to a ridge of the inorganic filler in the outermost layer obtained in the evaluation of the electrophotographic photoreceptor, and the toner approximate true sphere radius $R_3$ (nm) obtained in the evaluation of the toner.

[Numerical formula 7]

$$R_2 \leq 2\sqrt{2R_1R_3 - R_1^2} \quad (1)$$

$$0 < R_1 < R_3 \quad (2)$$

$$0 < R_2 \leq 250 \quad (3)$$

(Abrasion of Electrophotographic Photoreceptor)

By removing a brush roller (lubricant application brush) and a lubricant (lubricant rod) from each of electrophotographic image forming apparatuses 1 to 21 obtained above, the lubricant supplier was removed.

Subsequently, using each of these image forming apparatuses, an endurance test for continuously printing 100,000 sheets of a test image including two vertical belt-shaped solid images (width 5 cm) in A4 transverse feeding was performed under a low temperature and low humidity environment (LL environment) at 10° C. and 15% RH without a lubricant.

Then, thicknesses of 10 portions corresponding to the vertical belt-shaped solid image portion of each of the electrophotographic photoreceptors before and after the endurance test (excluding a portion at least 3 cm from both ends because both ends of a support are likely to have uneven film thickness) were measured randomly using an overcurrent type film thickness measuring device ("EDDY 560C" manufactured by HELMUT FISCHER GMBH). An average value thereof was determined, and was taken as the thickness of the vertical belt-like solid image. Then, a difference between the thickness of the vertical belt-shaped solid image before the endurance test and the thickness of the vertical belt-shaped solid image after the endurance test was taken as an abrasion amount, and the abrasion amount was evaluated according to the following evaluation criteria. Note that a sample having an abrasion amount of 0.20 μm or less was determined to be practically usable.

[Evaluation Criteria]

A: Abrasion amount is 0.05 μm or less,

B: Abrasion amount is larger than 0.05 μm and 0.10 μm or less,

C: Abrasion amount is larger than 0.10 μm and 0.15 μm or less,

D: Abrasion amount is larger than 0.15 μm and 0.20 μm or less, and

E: Abrasion amount is larger than 0.20 μm.

(Abrasion of Cleaning Blade)

By removing a brush roller (lubricant application brush) and a lubricant (lubricant rod) from each of electrophotographic image forming apparatuses 1 to 21 obtained above, the lubricant supplier was removed.

Subsequently, using each of these image forming apparatuses, an endurance test for continuously printing 100,000 sheets of a test image including two vertical belt-shaped solid images (width 5 cm) in A4 transverse feeding was performed under a low temperature and low humidity environment (LL environment) at 10° C. and 15% RH without a lubricant.

Then, a portion corresponding to the vertical belt-shaped solid image portion of a cleaning blade before and after the endurance test was observed using a shape measuring laser microscope ("VK-X100" manufactured by Keyence Corporation), and an abrasion width was calculated. Then, a difference between the abrasion width of the cleaning blade before the endurance test and the abrasion width of the cleaning blade after the endurance test was taken as an abrasion amount, and the abrasion amount was evaluated according to the following evaluation criteria. Note that a sample having an abrasion amount of 20 μm or less was determined to be practically usable.

[Evaluation Criteria]

A: Abrasion width is 5 μm or less,

B: Abrasion width is larger than 5 μm and 10 μm or less,

C: Abrasion width is larger than 10 μm and 15 μm or less, and

D: Abrasion width is larger than 15 μm and 20 μm or less,

E: Abrasion width is larger than 20 μm.

(Image Defects Due to Cleaning Failure (FD Streak))

In the lubricant suppler of each of the electrophotographic image forming apparatuses 1 to 21 obtained above, by adjusting a pressure spring of a lubricant (zinc stearate, lubricant rod) such that a pressing force of the brush roller (lubricant application brush) against the photoreceptor was 0.67 N, the lubricant consumption amount was adjusted so as to be equivalent to 0.05 g/km.

Subsequently, using each of these image forming apparatuses, an endurance test for continuously printing 100,000 sheets of a test image including two vertical belt-shaped solid images (width 5 cm) in A4 transverse feeding was performed under a low temperature and low humidity environment (LL environment) at 10° C. and 15% RH with a small amount of lubricant applied.

Then, after the endurance test, in a low temperature and low humidity environment (LL environment) at 10° C. and 15% RH, a halftone image was printed on 100 sheets of A3 size neutral paper such that a black area was located forward and a white area was located in a rear area in a sheet conveyance direction. Regarding a white area of the 100th printed sheet, contamination generated by toner slippage was visually observed, and contamination by external additive slippage in the lubricant application brush was visually observed. Cleaning performance was evaluated according to the following evaluation criteria. Note that a case in which the evaluation result was "A" or "B" was judged to be acceptable.

[Evaluation Criteria]

A: No contamination by external additive slippage is observed in a lubricant application brush, and there is no problem, B: Contamination by external additive slippage is observed partially in a lubricant application brush, but a streak-like stain is not observed visually on an image, and there is no problem in practical use, and C: Contamination by external additive slippage is observed in a lubricant application brush, a streak-like stain is observed visually on an image, and there is a problem in practical use.

(Transferability onto Embossed Sheet (Uneven Sheet))

By removing a brush roller (lubricant application brush) and a lubricant (lubricant rod) from each of electrophotographic image forming apparatuses 1 to 21 obtained above, the lubricant supplier was removed.

Subsequently, using each of these image forming apparatuses, an endurance test for continuously printing 100,000 sheets of a test image including two vertical belt-shaped solid images (width 5 cm) in A4 transverse feeding was performed under a low temperature and low humidity environment (LL environment) at 10° C. and 15% RH without a lubricant.

Subsequently, in each case before and after the endurance test, a transfer ratio of a solid image onto an embossed sheet (uneven sheet) (trade name: "LEATHAC 66" manufactured by Tokushu Tokai Paper Co., Ltd., having a basis weight of 203 g/m$^2$, and having a maximum depth of 100 to 150 μm at a recess on a sheet surface) was evaluated, and transferability onto an uneven sheet was evaluated.

Here, regarding the transfer ratio, when a solid image was printed, a development bias was adjusted such that the attachment amount of a toner on a transfer belt (the attachment amount on the transfer belt) was 4 g/m$^2$. The attachment amount (g/m$^2$) of the toner on an uneven sheet after secondary transfer was measured, and the transfer ratio was calculated by the following formula.

$$\text{Transfer ratio (\%)} = (\text{Attachment amount (g/m}^2\text{) of toner on uneven sheet/attachment amount (g/m}^2\text{) of toner on transfer belt}) \times 100 \quad \text{[Numerical formula 8]}$$

Then, transferability onto an uneven sheet was evaluated according to the following evaluation criteria. Note that a case in which the evaluation result was "A" or "B" was judged to be acceptable.

[Evaluation Criteria]

A: Transfer ratio is 95% or more,

B: Transfer ratio is 90% or more and less than 95%, and

C: Transfer ratio is less than 90%.

Table 2 below illustrates characteristics and the like of the photoreceptors and toners mounted on the electrophotographic image forming apparatuses. Table 3 below illustrates evaluation results of the electrophotographic image forming apparatuses.

TABLE 2

Photoreceptors and toners mounted on electrophotographic image forming apparatuses

| Electrophotographic image forming apparatus No. | Electrophotographic photoreceptor | | | | Toner | | | | | | | |
|---|---|---|---|---|---|---|---|---|---|---|---|---|
| | | | | | External additive (Large-diameter particles) | | | External additive average projection height [nm] | Toner approximate true sphere radius $R_3$ [nm] | Coverage of toner base particles [%] | $R_2'$ [nm] | |
| | No. | Inorganic filler | Average projection height $R_1$ [nm] | Average distance $R_2$ between projections [nm] | No. | Type | Particle diameter [nm] | | | | | |
| 1 | 1 | Surface-treated particles 1 | 10 | 240 | 1 | $SiO_2$ | 80 | 25 | 3025 | 75 | 492 | Example 1 |
| 2 | 2 | Surface-treated particles 2 | 10 | 240 | 1 | $SiO_2$ | 80 | 25 | 3025 | 75 | 492 | Example 2 |
| 3 | 3 | Surface-treated particles 3 | 10 | 240 | 1 | $SiO_2$ | 80 | 25 | 3025 | 75 | 492 | Example 3 |
| 4 | 4 | Surface-treated particles 3 | 10 | 120 | 1 | $SiO_2$ | 80 | 25 | 3025 | 75 | 492 | Example 4 |
| 5 | 4 | Surface-treated particles 3 | 10 | 120 | 2 | $SiO_2$ | 60 | 15 | 3015 | 75 | 491 | Example 5 |
| 6 | 4 | Surface-treated particles 3 | 10 | 120 | 3 | $SiO_2$ | 140 | 35 | 3035 | 75 | 492 | Example 6 |
| 7 | 4 | Surface-treated particles 3 | 10 | 120 | 4 | $SiO_2$ | 160 | 40 | 3040 | 75 | 493 | Example 7 |
| 8 | 4 | Surface-treated particles 3 | 10 | 120 | 5 | $TiO_2$ | 90 | 28 | 3028 | 75 | 492 | Example 8 |
| 9 | 4 | Surface-treated particles 3 | 10 | 120 | 6 | $Al_2O_3$ | 100 | 30 | 3030 | 75 | 492 | Example 9 |
| 10 | 5 | Surface-treated particles 4 | 20 | 130 | 1 | $SiO_2$ | 80 | 25 | 3025 | 75 | 695 | Example 10 |
| 11 | 6 | Surface-treated particles 5 | 30 | 140 | 1 | $SiO_2$ | 80 | 25 | 3025 | 75 | 850 | Example 11 |
| 12 | 7 | Surface-treated particles 6 | 50 | 220 | 1 | $SiO_2$ | 80 | 25 | 3025 | 75 | 1095 | Example 12 |

TABLE 2-continued

Photoreceptors and toners mounted on electrophotographic image forming apparatuses

| Electrophotographic image forming apparatus No. | Electrophotographic photoreceptor No. | Inorganic filler | Average projection height $R_1$ [nm] | Average distance $R_2$ between projections [nm] | Toner: External additive (Large-diameter particles) No. | Type | Particle diameter [nm] | External additive average projection height [nm] | Toner approximate true sphere radius $R_3$ [nm] | Coverage of toner base particles [%] | $R_2'$ [nm] | |
|---|---|---|---|---|---|---|---|---|---|---|---|---|
| 13 | 8 | Surface-treated particles 7 | 60 | 230 | 1 | $SiO_2$ | 80 | 25 | 3025 | 75 | 1199 | Example 13 |
| 14 | 9 | Surface-treated particles 8 | 30 | 160 | 1 | $SiO_2$ | 80 | 25 | 3025 | 75 | 850 | Example 14 |
| 15 | 10 | Surface-treated particles 9 | 30 | 140 | 1 | $SiO_2$ | 80 | 25 | 3025 | 75 | 850 | Example 15 |
| 16 | 11 | Surface-treated particles 10 | 30 | 140 | 1 | $SiO_2$ | 80 | 25 | 3025 | 75 | 850 | Example 16 |
| 17 | 12 | Surface-treated particles 11 | 30 | 140 | 1 | $SiO_2$ | 80 | 25 | 3025 | 75 | 850 | Example 17 |
| 18 | 13 | Surface-treated particles 9 | 30 | 320 | 1 | $SiO_2$ | 80 | 25 | 3025 | 75 | 850 | Comparative Example 1 |
| 19 | 14 | Untreated particles 12 | 35 | 350 | 1 | $SiO_2$ | 80 | 25 | 3025 | 75 | 918 | Comparative Example 2 |
| 20 | 10 | Surface-treated particles 9 | 30 | 140 | 7 | $SiO_2$ | 80 | 25 | 3025 | 65 | 850 | Comparative Example 3 |
| 21 | 15 | Surface-treated particles 13 | 4 | 260 | 8 | $SiO_2$ | 80 | 25 | 1775 | 75 | 238 | Comparative Example 4 |

TABLE 3

Evaluation results of electrophotographic image forming apparatuses and electrophotographic image forming methods

| Electrophotographic image forming apparatus No. | Abrasion of photoreceptor | Abrasion of blade | Cleaning performance | Transferability onto uneven sheet: Before endurance test | After endurance test | |
|---|---|---|---|---|---|---|
| 1 | C | C | B | B | B | Example 1 |
| 2 | C | C | B | B | B | Example 2 |
| 3 | C | B | B | B | B | Example 3 |
| 4 | C | B | B | B | B | Example 4 |
| 5 | C | C | B | B | B | Example 5 |
| 6 | C | B | B | B | B | Example 6 |
| 7 | C | C | B | B | B | Example 7 |
| 8 | C | C | B | B | B | Example 8 |
| 9 | C | C | B | B | B | Example 9 |
| 10 | B | B | B | B | B | Example 10 |
| 11 | A | B | A | B | B | Example 11 |
| 12 | A | B | B | B | B | Example 12 |
| 13 | A | C | B | B | B | Example 13 |
| 14 | B | B | B | B | B | Example 14 |
| 15 | A | A | A | A | A | Example 15 |
| 16 | A | A | A | A | A | Example 16 |
| 17 | A | A | A | A | A | Example 17 |
| 18 | E | D | C | A | C | Comparative Example 1 |
| 19 | E | D | C | B | C | Comparative Example 2 |
| 20 | C | C | C | C | C | Comparative Example 3 |
| 21 | C | C | C | C | C | Comparative Example 4 |

From the above results, it has been confirmed that the electrophotographic image forming apparatuses 1 to 17 according to an embodiment of the present invention and the electrophotographic image forming method using the electrophotographic image forming apparatuses 1 to 17 make the abrasion amounts of the photoreceptor and the cleaning blade small, make cleaning performance excellent, and further make transferability onto an uneven sheet favorable.

Meanwhile, it has been confirmed that in the electrophotographic image forming apparatuses 18 to 21 according to Comparative Examples 1 and 2 in which the average distance $R_2$ (nm) between projections of a projection structure due to a ridge of the inorganic filler in the outermost layer is more than 250 nm, Comparative Example 3 in which the coverage of toner base particles is less than 70%, and Comparative Example 4 in which the average distance $R_2$ (nm) between projections is larger than $R_2'$, and the electrophotographic image forming method using the electrophotographic image forming apparatuses 18 to 21, a sufficient effect cannot be obtained.

<Evaluation of Electrophotographic Image Forming Apparatus Using Proximity Charging Type Charging Device as Charger and Electrophotographic Image Forming Method>

(Preparation of Electrophotographic Image Forming Apparatus)

The electrophotographic photoreceptors prepared above and the toners prepared above were mounted on a full color printer ("bizhub PRESS (registered trademark) C638" manufactured by Konica Minolta Inc.) so as to have similar combinations to the electrophotographic image forming apparatuses 15 and 18 to 20, respectively, thus preparing electrophotographic image forming apparatuses 22 to 25.

Here, the full color printer does not include, as a lubricant supplier, a means that supplies a lubricant by a method for applying a solid lubricant with a brush roller, and includes, as a charger, a proximity charging type charging device that charges a photoreceptor in a state where a charging roller is in contact with the photoreceptor or close thereto.

Note that the full color printer can also include, as a lubricant supplier, a means that supplies a lubricant to a surface of the electrophotographic photoreceptor by action of a developing electric field formed in the developer by externally adding a fine powder lubricant to toner base particles in preparation of a toner. However, in the preparation of the toner, a fine powder lubricant is not externally added to the toner base particles. Therefore, the prepared electrophotographic image forming apparatus does not include a lubricant supplier.

That is, the prepared electrophotographic image forming apparatus includes: an electrophotographic photoreceptor; a charger that charges a surface of the electrophotographic photoreceptor; an exposer that exposes the charged electrophotographic photoreceptor to form an electrostatic latent image; a developer that supplies a toner to the electrophotographic photoreceptor on which the electrostatic latent image is formed to form a toner image; a transferer that transfers a toner image formed on the electrophotographic photoreceptor; and a cleaner that removes a residual toner remaining on a surface of the electrophotographic photoreceptor.

(Abrasion of Electrophotographic Photoreceptor)

Abrasion of an electrophotographic photoreceptor was evaluated using the electrophotographic image forming apparatuses 22 to 25 by a similar method and with similar evaluation criteria to the evaluation of the electrophotographic image forming apparatus and the electrophotographic image forming method using a non-contact type charging device as the charger described above.

(Abrasion of Cleaning Blade)

Abrasion of a cleaning blade was evaluated using the electrophotographic image forming apparatuses 22 to 25 by a similar method and with similar evaluation criteria to the evaluation of the electrophotographic image forming apparatus and the electrophotographic image forming method using a non-contact type charging device as the charger described above.

(Image Defects Due to Cleaning Failure)

Using each of the electrophotographic image forming apparatuses 22 to 25, an endurance test for continuously printing 100,000 sheets of a test image including two vertical belt-shaped solid images (width 5 cm) in A4 transverse feeding was performed under a low temperature and low humidity environment (LL environment) at 10° C. and 15% RH without a lubricant.

Then, after the endurance test, in a low temperature and low humidity environment (LL environment) at 10° C. and 15% RH, a halftone image was printed on 100 sheets of A3 size neutral paper such that a black area was located forward and a white area was located in a rear area in a sheet conveyance direction. Regarding a white area of the 100th printed sheet, contamination generated by toner slippage was visually observed, and contamination by external additive slippage in the charging roller was visually observed. Cleaning performance was evaluated according to the following evaluation criteria. Note that a case in which the evaluation result was "A" or "B" was judged to be acceptable.

[Evaluation Criteria]

A: No contamination by external additive slippage is observed in a charging roller, and there is no problem, B: Contamination by external additive slippage is observed partially in a charging roller, but a streak-like stain is not observed visually on an image, and there is no problem in practical use, and C: Contamination by external additive slippage is observed in a charging roller, a streak-like stain is observed visually on an image, and there is a problem in practical use.

Table 4 below illustrates evaluation results of the electrophotographic image forming apparatuses.

TABLE 4

Evaluation results of electrophotographic image forming apparatuses and electrophotographic image forming methods

| Electrophotographic image forming apparatus No. | Electrophotographic photoreceptor No. | Toner No. | Abrasion of photoreceptor | Abrasion of blade | Cleaning performance | |
|---|---|---|---|---|---|---|
| 22 | 10 | 1 | A | A | A | Example 18 |
| 23 | 13 | 1 | E | D | C | Comparative Example 5 |
| 24 | 14 | 1 | E | D | C | Comparative Example 6 |
| 25 | 10 | 7 | C | C | C | Comparative Example 7 |

From the above results, it has been confirmed that the electrophotographic image forming apparatus 22 according to an embodiment of the present invention and the electrophotographic image forming method using the electrophotographic image forming apparatus 22 make the abrasion amounts of the photoreceptor and the cleaning blade small, and make cleaning performance excellent.

Meanwhile, it has been confirmed that in the electrophotographic image forming apparatuses 23 to 25 according to Comparative Examples 5 and 6 in which the average distance $R_2$ (nm) between projections of a projection structure due to a ridge of the inorganic filler in the outermost layer is more than 250 nm, and Comparative Example 7 in which the coverage of toner base particles is less than 70%, and the electrophotographic image forming method using the electrophotographic image forming apparatuses 23 to 25, a sufficient effect cannot be obtained.

Although embodiments of the present invention have been described and illustrated in detail, the disclosed embodiments are made for purposes of illustration and example only and not limitation. The scope of the present invention should be interpreted by terms of the appended claims

What is claimed is:

1. An electrophotographic image forming apparatus comprising:

an electrophotographic photoreceptor;

a charger that charges a surface of the electrophotographic photoreceptor;

an exposer that exposes the charged electrophotographic photoreceptor to form an electrostatic latent image;

a developer that supplies a toner to the electrophotographic photoreceptor on which the electrostatic latent image is formed to form a toner image;

a transferer that transfers a toner image formed on the electrophotographic photoreceptor; and a cleaner that removes a residual toner remaining on a surface of the electrophotographic photoreceptor, wherein the electrophotographic photoreceptor includes an outermost layer formed of a polymerized and cured product of a composition containing a polymerizable monomer and an inorganic filler, a surface of the outermost layer has a projection structure due to a ridge of the inorganic filler, the toner contains toner base particles and metal oxide particles as an external additive externally added to the toner base particles, 70% or more of the toner base particles are covered with the metal oxide particles as the external additive, and following formulas (1) to (3) are satisfied if an average projection height (nm) of the outermost layer is represented by $R_1$, an average distance (nm) between projections of a projection structure due to a ridge of the inorganic filler in the outermost layer is represented by $R_2$, and an approximate true sphere radius (nm) of the toner is represented by $R_3$.

[Numerical formula 1]

$$R_2 \leq 2\sqrt{2R_1R_3 - R_1^2} \quad (1)$$

$$0 < R_1 < R_3 \quad (2)$$

$$0 < R_2 \leq 250 \quad (3)$$

2. The electrophotographic image forming apparatus according to claim 1, wherein the inorganic filler has been surface-treated with a side chain type silicone surface treatment agent having a silicone chain as a side chain.

3. The electrophotographic image forming apparatus according to claim 2, wherein the side chain type silicone surface treatment agent has a poly (meth)acrylate main chain or a silicone main chain as a polymer main chain.

4. The electrophotographic image forming apparatus according to claim 1, wherein the inorganic filler has a group derived from a polymerizable group.

5. The electrophotographic image forming apparatus according to claim 1, wherein the inorganic filler is formed of core-shell structure composite particles each including a core material and an outer shell formed of metal oxide.

6. The electrophotographic image forming apparatus according to claim 1, wherein the inorganic filler has a number average primary particle diameter of 80 nm or more and 200 nm or less.

7. The electrophotographic image forming apparatus according to claim 1, wherein the metal oxide particles as the external additive are silica particles.

8. The electrophotographic image forming apparatus according to claim 1, wherein at least one type of the metal oxide particles as the external additive has a number average primary particle diameter of 70 nm or more and 150 nm or less.

9. An electrophotographic image forming method comprising:

charging a surface of an electrophotographic photoreceptor;

exposing the charged electrophotographic photoreceptor to form an electrostatic latent image;

supplying a toner to the exposed electrophotographic photoreceptor to form a toner image;

transferring a toner image formed on the electrophotographic photoreceptor; and removing a residual toner remaining on a surface of the electrophotographic photoreceptor, wherein the electrophotographic photoreceptor includes an outermost layer formed of a polymerized and cured product of a composition containing a polymerizable monomer and an inorganic filler, a surface of the outermost layer has a projection structure due to a ridge of the inorganic filler, the toner contains toner base particles and metal oxide particles as an external additive externally added to the toner base particles, 70% or more of the toner base particles are covered with the metal oxide particles as the external additive, and following formulas (1) to (3) are satisfied if an average projection height (nm) of the outermost layer is represented by $R_1$, an average distance (nm) between projections of a projection structure due to a ridge of the inorganic filler in the outermost layer is represented by $R_2$, and an approximate true sphere radius (nm) of the toner is represented by $R_3$

[Numerical formula 2]

$$R_2 \leq 2\sqrt{2R_1R_3 - R_1^2} \quad (1)$$

$$0 < R_1 < R_3 \quad (2)$$

$$0 < R_2 \leq 250 \quad (3)$$

* * * * *